US010900219B1

(12) United States Patent
Goodwin

(10) Patent No.: US 10,900,219 B1
(45) Date of Patent: Jan. 26, 2021

(54) HURRICANE PROTECTIVE SYSTEMS FOR PROTRUDING OPENINGS

(71) Applicant: Robert F. Goodwin, Charleston, SC (US)

(72) Inventor: Robert F. Goodwin, Charleston, SC (US)

(73) Assignee: Robert F. Goodwin, Charleston, SC (US)

( * ) Notice: Subject to any disclaimer, the term of this patent is extended or adjusted under 35 U.S.C. 154(b) by 0 days.

(21) Appl. No.: 15/961,311

(22) Filed: Apr. 24, 2018

(51) Int. Cl.

| | |
|---|---|
| ***E04B 9/02*** | (2006.01) |
| ***E04B 1/41*** | (2006.01) |
| ***E06B 9/02*** | (2006.01) |
| *E06B 9/00* | (2006.01) |
| *E04B 1/38* | (2006.01) |

(52) U.S. Cl.
CPC ..... *E04B 1/40* (2013.01); *E06B 9/02* (2013.01); *E04B 2001/405* (2013.01); *E06B 2009/005* (2013.01)

(58) Field of Classification Search
USPC ..... 411/178, 384, 397
See application file for complete search history.

(56) References Cited

U.S. PATENT DOCUMENTS 3,292,893 A * 12/1966 Williams ..... E04G 17/0658 249/191
3,926,400 A 12/1975 Franc
4,248,022 A 2/1981 Walker
4,450,884 A 5/1984 Hemmerle et al.
4,708,554 A 11/1987 Howard
4,726,560 A 2/1988 Dotson
4,783,040 A 11/1988 Lindberg et al.
5,050,365 A 9/1991 Edgar et al.
D331,211 S * 11/1992 Harris ..... D12/401
5,351,456 A 10/1994 Paine, Jr.
5,430,982 A 7/1995 Bane
5,487,244 A 1/1996 Hill
5,594,233 A 1/1997 Gower
5,941,031 A 8/1999 Fullwood
6,161,605 A * 12/2000 Pena ..... E06B 9/0638 160/105
6,293,059 B1 * 9/2001 Goodwin ..... E06B 9/02 52/202
6,685,153 B2 * 2/2004 Foreman ..... F16L 3/14 24/16 PB
D489,035 S * 4/2004 Butler ..... D12/401
6,776,260 B2 * 8/2004 Cjepa ..... A62B 1/22 182/137
7,484,334 B1 * 2/2009 Oviedo-Reyes ..... E04H 9/14 52/23
7,997,036 B1 * 8/2011 Motosko ..... E06B 9/02 49/57
10,081,979 B1 * 9/2018 Buonpane ..... E06B 9/02
(Continued)

*Primary Examiner* — Brian E Glessner
*Assistant Examiner* — Daniel J Kenny
(74) *Attorney, Agent, or Firm* — Thrive IP®; Jeremy M. Stipkala

(57) ABSTRACT

A system protects an opening such as a window or a door from high wind and wind-borne debris by holding a panel such as plywood over the opening. An anchor bolt engages a resilient strap that holds the panel; a bracket secures the resilient strap to the head of the anchor bolt. In some cases, the anchor bolt can retract into the wall next to the opening when the system is not in use.

19 Claims, 20 Drawing Sheets

© 2018 Robert F. Goodwin (17 U.S.C. § 401)

(56) References Cited

U.S. PATENT DOCUMENTS

| | | | | |
|---|---|---|---|---|
| 2007/0193137 | A1* | 8/2007 | DeBoth | E06B 9/02 52/202 |
| 2009/0151276 | A1* | 6/2009 | Debes, Jr. | E06B 9/02 52/203 |
| 2010/0281783 | A1* | 11/2010 | Harrington | E04H 9/14 52/2.23 |
| 2011/0067347 | A1* | 3/2011 | Myny | E06B 9/02 52/712 |

* cited by examiner

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

© 2018 Robert F. Goodwin (17 U.S.C. § 401)

HURRICANE PROTECTIVE SYSTEMS FOR PROTRUDING OPENINGS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to systems for protecting windows and doors during a high-wind event such as a hurricane.

BACKGROUND OF THE INVENTION

Applicant invented various systems for protecting openings such as doors and windows against wind-borne debris, and patented those systems in U.S. Pat. No. 6,293,059 B1. The '059 patent is incorporated herein by reference in its entirety. Now, unexpectedly, Applicant has invented new, improved systems that can protect a wider variety of openings, including windows and doors that have frames that protrude from the surface of the surrounding wall.

Significantly, window and door units that protrude from the adjacent wall pose a significant problem for adequately protecting the opening. Anchoring any protection system in the window or door unit itself is unacceptable, and building codes reflect that by requiring any protection system to anchor in the adjacent wall—specifically, in the structural wall framing or into the 2"×4" studs. Heretofore, it has not been very convenient or satisfactory to employ known systems to protect those openings.

SUMMARY OF THE INVENTION

Certain embodiments of the present invention provide systems for protecting an opening from high wind and wind-borne debris, one such system comprising:

an anchor bolt adapted for anchoring into a wall adjacent to the opening, comprising a head connecting a shaft;

a resilient strap adapted to support a panel, the resilient strap comprising at least one bolt engagement opening for receiving the head of the anchor bolt, a panel support portion, and at least one extension portion joining the at least one bolt engagement opening to the panel support portion;

a bracket for securing the resilient strap to the head of the anchor bolt, the bracket comprising an aperture for receiving the head of the anchor bolt and a slot extending from the aperture for securing the resilient strap to the anchor bolt.

Further embodiments of the present invention relate to anchor bolts for a system for protecting an opening, one such anchor bolt comprising:

a threaded shaft for anchoring into a wall;

a head having an axial stem; and a reciprocating chamber embracing the axial stem and connecting the head to the threaded shaft.

Some embodiments provide brackets for a system for protecting an opening, one such bracket comprising:

an aperture for receiving a head of a bolt; and a slot extending from the aperture, wherein the slot is narrower than the head of the bolt but wider than a shaft of the bolt.

Additional embodiments relate to resilient straps for a system for protecting an opening, one such resilient strap comprising:

a first bolt engagement opening for receiving a head of a bolt;

a panel support portion; and a first extension portion joining the first bolt engagement opening to the panel support portion.

Still further embodiments relate to methods of protecting an opening from high wind and wind-borne debris, one such method comprising: obtaining a panel having a plurality of strap slots therein;

attaching a resilient strap to the panel by feeding the resilient strap through a strap slot in the plurality of strap slots, the resilient strap comprising a bolt engagement opening for receiving the head of an anchor bolt, a panel support portion, and an extension portion joining the bolt engagement opening to the panel support portion;

engaging an anchor bolt anchored into a wall adjacent to the opening, the anchor bolt comprising a head connecting a shaft, by passing the head into the bolt engagement opening of the resilient strap; and securing the resilient strap on the anchor bolt by passing the head of the anchor bolt into a bracket comprising an aperture for receiving the head and a slot extending from the aperture, and sliding the bracket so the head enters the slot, thereby positioning the panel over the opening and thereby protecting an opening from high wind and wind-borne debris.

Yet other embodiments relate to methods of making an anchor bolt, one such method comprising:

obtaining a cylindrical reciprocating chamber having a first end and a second end;

crimping a threaded bushing in the first end;

securing a threaded shaft in the threaded bushing;

placing a head having an axial stem into a smooth bushing, and securing a nut to the axial stem to secure the axial stem in the smooth bushing; and crimping the smooth bushing in the second end of the cylindrical reciprocating chamber, thereby connecting the head to the threaded shaft via the cylindrical reciprocating chamber, and thereby making the anchor bolt.

Certain further embodiments relate to systems that do not require a resilient strap, perhaps because a window unit does not protrude beyond the adjacent wall, for example. Thus, certain further embodiments of the present invention relate to systems for protecting an opening from high wind and wind-borne debris, one such system comprising:

an anchor bolt adapted for anchoring into a wall adjacent to the opening, comprising a head connecting a shaft; and a bracket for securing a panel to the head of the anchor bolt, the bracket comprising an aperture for receiving the head of the anchor bolt and a slot extending from the aperture for securing the panel to the anchor bolt.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
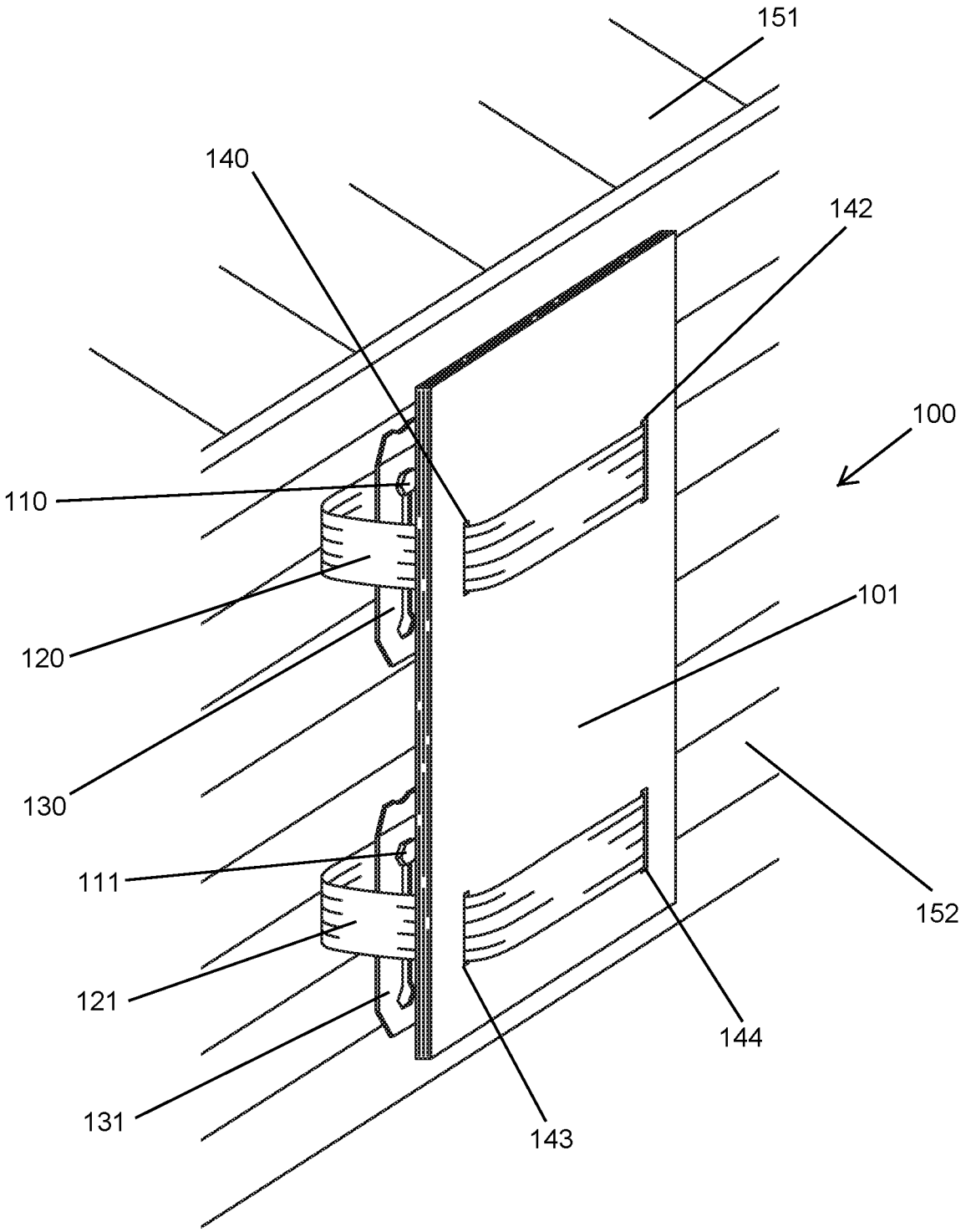
FIGS. 1 and 2 show, in one embodiment of the invention, system 100 protecting a window (not seen) in wall 152.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Where ever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to."

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

As stated herein, some embodiments relate to a system for protecting an opening from high wind and wind-borne debris, comprising:

an anchor bolt adapted for anchoring into a wall adjacent to the opening, comprising a head connecting a shaft;

a resilient strap adapted to support a panel, the resilient strap comprising at least one bolt engagement opening for receiving the head of the anchor bolt, a panel support portion, and at least one extension portion joining the at least one bolt engagement opening to the panel support portion;

a bracket for securing the resilient strap to the head of the anchor bolt, the bracket comprising an aperture for receiving the head of the anchor bolt and a slot extending from the aperture for securing the resilient strap to the anchor bolt.

Such a system can further comprise any useful components, such as, for example, a panel suitable for withstanding high wind and the impact of wind-borne debris against it. Any suitable panel material can be used, such as, for example, metal, wood, plastic, or a combination thereof. In some cases, wood and wood products can be used, such as, for example, oriented strand board and plywood. In some cases, plywood is stronger and lasts longer than oriented strand board. The panel can be coated, painted, colored, or otherwise rendered aesthetically pleasing; or the panel can simply have a functional appearance. Among other features, a panel useful with the systems of the present invention can have a plurality of strap slots. Strap slots can appear in any suitable configuration on the panel, such as, for example, one or two strap slots positioned near each corner of a rectangular panel. Singly or in pairs, strap slots receive the resilient straps as described herein, and allow the resilient straps to hold the panel over the opening. Strap slots can be imparted to the panel in any suitable manner, such as, for example, by cutting, drilling, molding, welding, or combinations thereof. Optionally, the panel further comprises padding to protect the opening and the surrounding frame from cosmetic or more serious damage from the panel mounted against them. In some cases, the panel is at least 0.25" thick. In other cases, the panel is no thicker than 4.0" thick. In still further cases, a panel is about 0.75" thick. Furthermore, the panel can be of any suitable dimensions relative to the opening it will protect. For example, the panel can be at least 1%, at least 5%, at least 10%, or at least 20% wider than the opening. For another example the panel can be at least 1%, at least 5%, at least 10%, or at least 20% longer or taller than the opening. In yet another example, the panel can be narrower or shorter than the opening, at the risk of offering less protection to the opening. Optionally, the panels can be labeled as to which opening is to be protected by which panel, and the orientation of the panel for deployment.

Any suitable opening can be protected by the systems of the present invention. In some cases, the opening is a window or a door. In further cases, the opening protrudes beyond the wall adjacent to the opening. In the past, protruding openings have presented an obstacle to deploying known systems for protecting such openings, as the anchor bolts would have to extend past the protrusion to engage the panel. As used herein, "frame" generally means the unit that forms the opening, such as a window unit or a door unit. Certain embodiments of the present invention address those situations in which the frame or window unit, for example, protrudes beyond the surrounding wall. "Frame" should not be confused with the structural framing, such as 2"×4" wall studs, that support the surrounding wall.

It can be helpful in some instances of the present invention if the anchor bolt is adapted to be permanently anchored into the wall adjacent to the opening. This prevents the need for a homeowner, for example, to install anchor bolts around each opening of a home as a storm approaches. Installation of anchor bolts can happen once, perhaps when the home is built, and the panels can be deployed using the permanently-installed anchor bolts without tools as needed. In other instances, the anchor bolt or a portion thereof can be adapted to be removed from the wall adjacent to the opening when there is no need to protect the opening. For example, a threaded shaft can be permanently installed in the wall, and a head comprising an axial shaft can be removable from the threaded shaft. Then, the head and axial shaft can be reinserted into the permanently-installed threaded shaft to support a panel when a storm approaches. Optionally, threads on the axial shaft can engage a threaded female chamber that is part of the threaded shaft permanently installed in the wall. An attractive cap, such as of plastic, can cover the threaded shaft when not in use.

In further instances of the present invention, the anchor bolt or a portion thereof is adapted to retract into the wall adjacent to the opening when there is no need to protect the opening, and the anchor bolt is adapted to be permanently anchored into the wall adjacent to the opening. In these instances, the head of the anchor bolt can be placed in a retracted position, and optionally covered with an attractive cap to hide and protect the head when not in use. Such a cap can be made out of any suitable material and colored any suitable color. Suitable materials and colors include, but are not limited to, white plastic. Optionally, the cap is colored or painted to match the wall adjacent the opening. When a storm approaches, the cap can be removed, and the head can be pulled out from the wall to receive the resilient strap as described below. Optionally, the head can connect to the shaft via a reciprocating chamber joining the head to the shaft.

The resilient straps that can be used in accordance with the present invention are not limited. In some cases, the resilient strap engages the panel substantially in the proximity of a single strap slot or two strap slots located relatively close together on the panel. In other cases, the resilient strap engages a strap slot on one side of the opening, crosses the panel, and engages another strap slot on the other side of the opening. Straps crossing a panel can cross in any desirable direction, such as horizontally, vertically, or diagonally.

Resilient straps can be made of any suitable material. In some cases, the resilient straps must be flexible enough to maneuver into position through one or more strap slots on the panel. In other cases, the resilient straps must be strong enough to hold the panel and withstand the forces applied to the panel during the storm. Accordingly, in certain cases, the resilient strap comprises high tensile strength steel, polymer, or a combination thereof. High tensile strength steel includes those steels known as spring steels. Any suitable polymer can be used, such as, for example, polyalkane including polyethylene and polypropylene, nylon, polyester, and combinations thereof. The material of the strap can be monolithic, woven, nonwoven, or combinations thereof.

The resilient strap comprises at least one bolt engagement opening. The bolt engagement opening fits over the head of the anchor bolt, and connects the resilient strap to the wall. An extension portion connects the bolt engagement opening to the panel support portion of the strap. In cases where the resilient strap is designed to engage two strap slots on the panel, there may optionally exist a first bolt engagement opening, and a second bolt engagement opening; and a first extension portion joining the first bolt engagement opening to the panel support portion, and a second extension portion joining the second bolt engagement opening to the panel support portion.

Sometimes, a resilient strap can be made in the field, that is, when the anchor bolts are being installed in the wall on either side of the opening. Once the anchor bolts are installed, and strap slots have been cut in the panel, two half-straps can be connected to the anchor bolts by their anchor bolt engagement openings, and passed through the respective strap slots. The loose ends of the half-straps can be trimmed to an appropriate length, leaving enough so the half-straps overlap with each other. Then, the region of overlap can be joined, for example, by melting, crimping, adhering, or a combination thereof, one half-strap to the other half-strap. Thereby, a resilient strap having the exactly correct length can be formed, comprising a first bolt engagement opening connected by a first extension portion to a first panel support portion, a second bolt engagement opening connected by a second extension portion to a second panel support portion; and the first panel support portion and the second panel support portion join together in a linking region where they overlap.

Sometimes, to accommodate slight variations in dimensions, a resilient strap can have more than one bolt engagement opening. That allows the bolt engagement opening at the correct position to be chosen when protecting an opening with a system of the present invention. It can be said, in certain instances, a first bolt engagement opening comprises a plurality of first bolt engagement openings; and if present, a second bolt engagement opening comprises a plurality of second bolt engagement openings.

Any suitable design for the bracket can be employed. As stated herein, a bracket may have an aperture for receiving the head of a bolt, and a slot extending from the aperture. The slot can have any suitable geometry, such as, for example, the slot can be narrower than the head of the bolt but wider than a shaft of the bolt. The bracket can have any suitable profile. In some cases, the bracket is substantially flat. In other cases, the bracket comprises a slope increasing from the aperture along the slot. The bracket can have any suitable shape. In some cases, the bracket has a rectangular shape. A rectangular shape can be helpful, for example when the aperture is placed on the head of the anchor bolt and then slid along the slot. The weight of the bracket hanging below the head of the anchor bolt can help keep the bracket from disengaging from the head.

The bracket can include any suitable material. For example, the bracket may comprise steel, aluminum, a structural polymer, or a combination thereof. Structural polymers include nylons, polyalkanes, polystyrenes, polyurethanes, and combinations thereof.

In some cases, a bracket can include a fingerhold comprising one or more structures, such as finger divots, for receiving one or more fingers. A fingerhold allows a user to push on the bracket when installing it, so that the bracket firmly holds the resilient strap to the anchor bolt.

Any suitable anchor bolt can be used. Sometimes, the shaft comprises a threaded shaft for anchoring into a wall; the head further comprises an axial stem; and the anchor bolt further comprises a reciprocating chamber embracing the axial stem and connecting the head to the threaded shaft. A reciprocating chamber can be a hollow cylinder that attaches to a threaded shaft at one end, and receives the head of the anchor bolt at the other end. This can be accomplished in any suitable fashion. For example, the reciprocating chamber can comprise a threaded bushing for connecting the threaded shaft. For another example, the reciprocating chamber can comprise a smooth bushing for embracing the axial stem.

Driving the anchor bolt into the wall next to an opening can be accomplished by any suitable means. In some cases, the smooth bushing of an anchor bolt comprises one or more engagement recesses proximal to the head, and the head of the anchor bolt comprises, proximal to the smooth bushing, one or more engagement fins adapted to engage the one or more engagement recesses. When the one or more engagement fins engages the one or more engagement recesses, turning the head turns the smooth bushing and the threaded shaft. This can be useful both for installing the anchor bolt into the wall, and for removing it from the wall if needed.

The anchor bolts and the components thereof can be made from one or more pieces. In some cases, the reciprocating chamber and the threaded bushing are made from a single piece. In further cases, the reciprocating chamber and the smooth bushing are made from a single piece. In still further cases, the reciprocating chamber, threaded bushing, and smooth bushing are made from a single piece.

The components of the systems of the present invention can be made by any suitable methods. In some cases, a method of making an anchor bolt, comprises:

obtaining a cylindrical reciprocating chamber having a first end and a second end;

crimping a threaded bushing in the first end;

securing a threaded shaft in the threaded bushing;

placing a head having an axial stem into a smooth bushing, and securing a nut to the axial stem to secure the axial stem in the smooth bushing; and crimping the smooth bushing in the second end of the cylindrical reciprocating chamber, thereby connecting the head to the threaded shaft via the cylindrical reciprocating chamber, and thereby making the anchor bolt.

Optionally, a suitable adhesive such as a currently-known thread-locking compound or composition, a smooth-surface to smooth-surface adhering compound or composition, epoxy, polyacrylate, methacrylate, or the like, can be used to secure threaded or smooth connections. Examples include those methacrylates sold under the brand name Vibra-Tite® by ND Industries, and LOCTITE® methacrylate adhesive.

Methods of protecting an opening, such as a window or door of a building, appear in certain embodiments of the present invention. One such method comprises:

obtaining a panel having a plurality of strap slots therein;

attaching a resilient strap to the panel by feeding the resilient strap through a strap slot in the plurality of strap slots, the resilient strap comprising a bolt engagement opening for receiving the head of an anchor bolt, a panel support portion, and an extension portion joining the bolt engagement opening to the panel support portion;

engaging an anchor bolt anchored into a wall adjacent to the opening, the anchor bolt comprising a head connecting a shaft, by passing the head into the bolt engagement opening of the resilient strap; and securing the resilient strap on the anchor bolt by passing the head of the anchor bolt into a bracket comprising an aperture for receiving the head and a slot extending from the aperture, and sliding the bracket so the head enters the slot, thereby positioning the panel over the opening and thereby protecting an opening from high wind and wind-borne debris.

Certain instances provide that the plurality of strap slots comprises pairs of strap slots. That allows a resilient strap to loop around a portion of the panel between the strap slots and back to the anchor bolt. Further instances provide that the resilient strap comprises a second extension portion joining a second bolt engagement opening to the panel support portion, and engaging the anchor bolt further comprises passing the head of the anchor bolt into the second bolt engagement opening.

Further instances of the present invention allow for the protection of an opening without using the resilient straps as described herein. That is possible, for example, when a window unit does not protrude much beyond the wall adjacent to the opening. An anchor bolt such as those described herein is installed in the wall; a panel such as a rectangular piece of plywood having a circular or similar holes where the anchor bolts will engage the panel, is mounted on the anchor bolts; and then a bracket such as those described herein is placed over the head of the anchor bolt to secure the panel to the wall. The anchor bolt or a portion thereof can retract into the wall when the system is not in use. The bracket can be any suitable bracket, such as those that are substantially flat, and those that have a sloping profile. Any suitable panel can be used as described herein. Holes, or other openings large enough to receive the head of an anchor bolt, are required in the panel instead of strap slots.

DETAILED DESCRIPTION OF THE DRAWINGS

Further embodiments of the present invention can be described by reference to the accompanying drawings.

Figure 2:
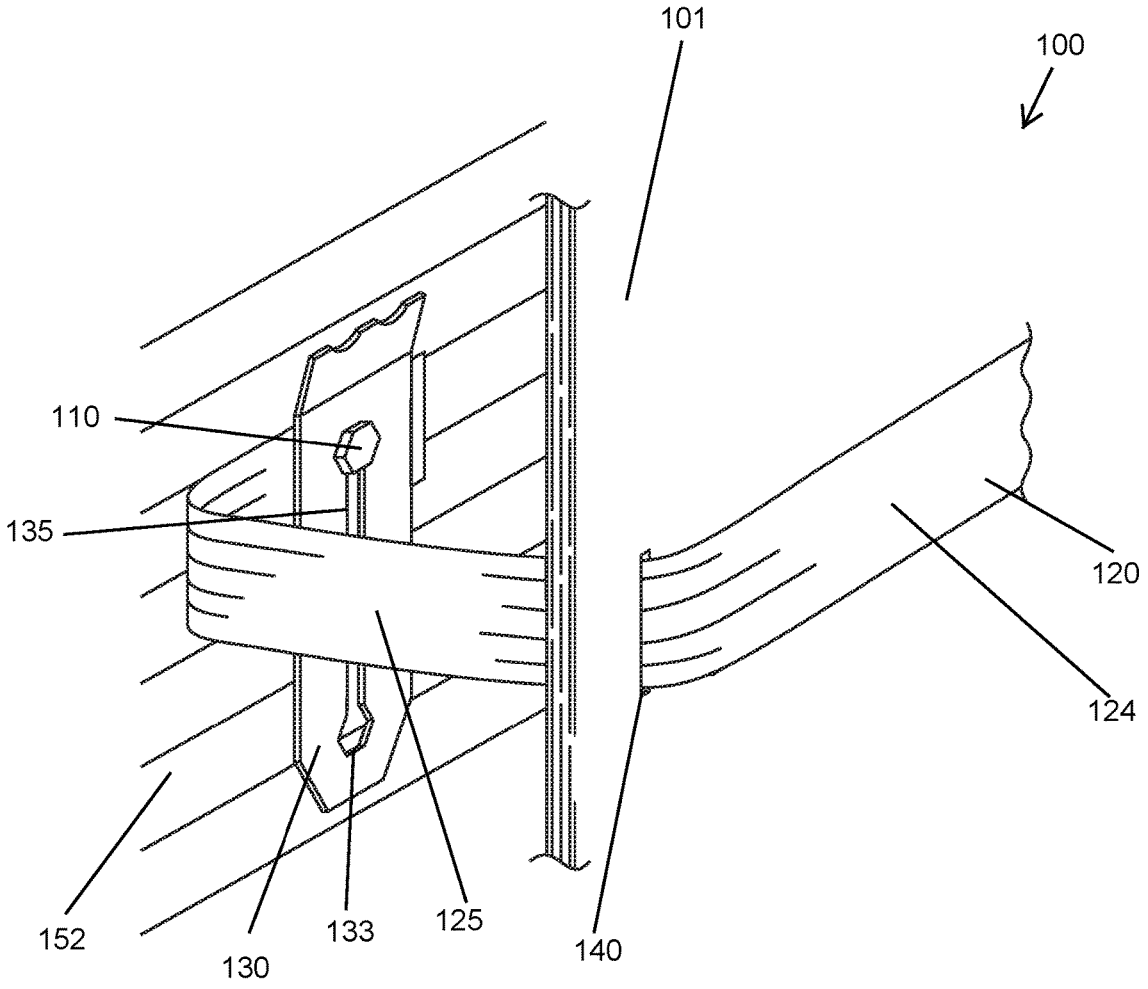

FIGS. 1 and 2 show, in one embodiment of the invention, system 100 protecting a window (not seen) in wall 152 under roof 151. Panel 101 such as, for example, a piece of plywood large enough to cover the window, has strap slots 140, 142, 143, 144. Resilient strap 120 passes through strap slots 140, 142 to support panel 101, and is held at wall 152 by anchor bolt 110 and secured by bracket 130 (and another anchor bolt and bracket unseen in the figure). Resilient strap 121 passes through strap slots 143, 144, and is held at wall 152 by anchor bolt 111 and secured by bracket 131 (and another anchor bolt and bracket unseen in the figure). Anchor bolt 110 and anchor bolt 111 both comprise a head connecting to a shaft (not seen). Resilient strap 120 comprises a bolt engagement opening (not seen; behind anchor bolt 110), panel support portion 124, an extension portion 125 that joins the bolt engagement opening to panel support portion 124. Bracket 130 comprises aperture 133 for receiving the head of anchor bolt 110, and slot 135 extending from aperture 133 for securing resilient strap 120 to anchor bolt 110. Resilient strap 120 engages strap slot 140 on one side of the window, crosses panel 101, and engages another strap slot on the other side of the window.

Figure 3:
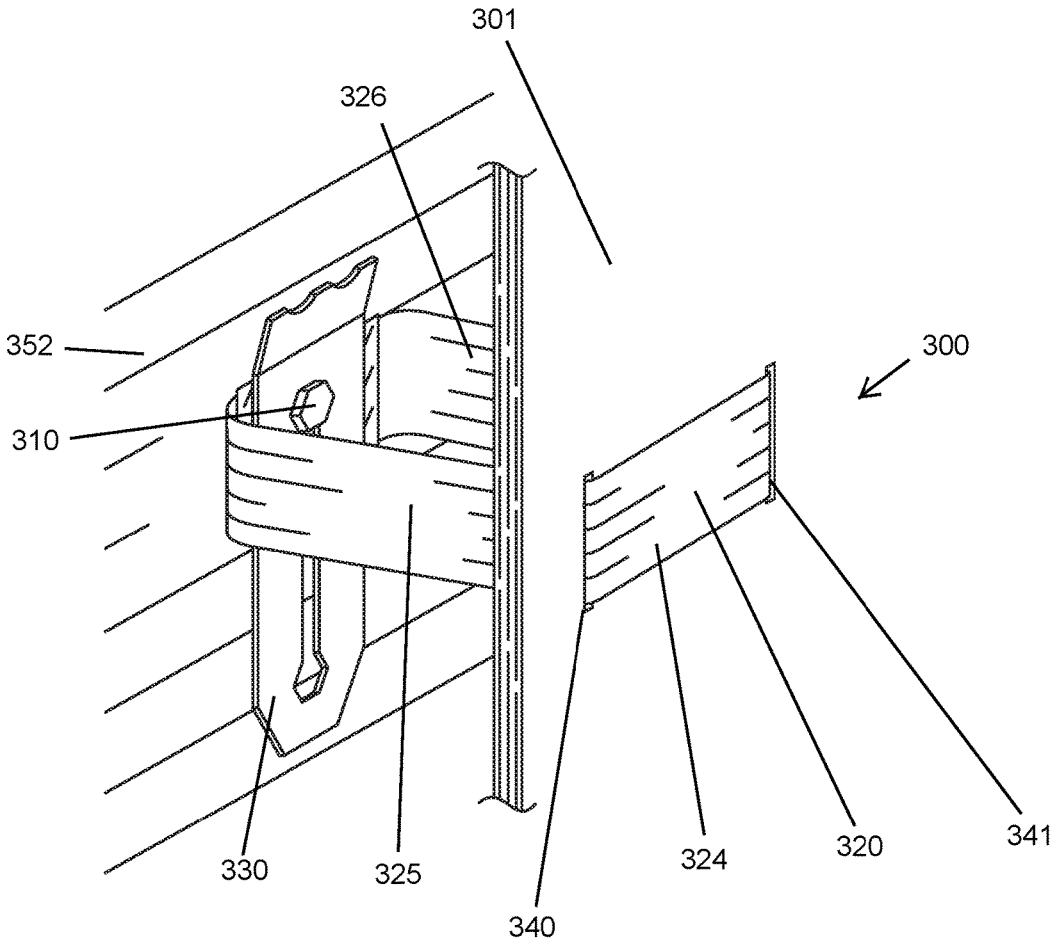
FIG. 3 shows, in another embodiment, system 300 protecting window (not seen) in wall 352.

FIG. 3 shows, in another embodiment, system 300 protecting window (not seen) in wall 352. Resilient strap 320 engages panel 301 substantially in the proximity of two strap slots 340, 341 located relatively close together on panel 301. Resilient strap 320 comprises a first bolt engagement opening (not seen) and a second bolt engagement opening (not seen). Resilient strap 320 further comprises panel support portion 324 and first extension portion 325, which joins the first bolt engagement opening to panel support portion 324. Resilient strap 320 further comprises a second extension portion 326, which joins the second bolt engagement opening to panel support portion 324. Bracket 330 secures resilient strap 320 to the head of anchor bolt 310.

Figure 4:
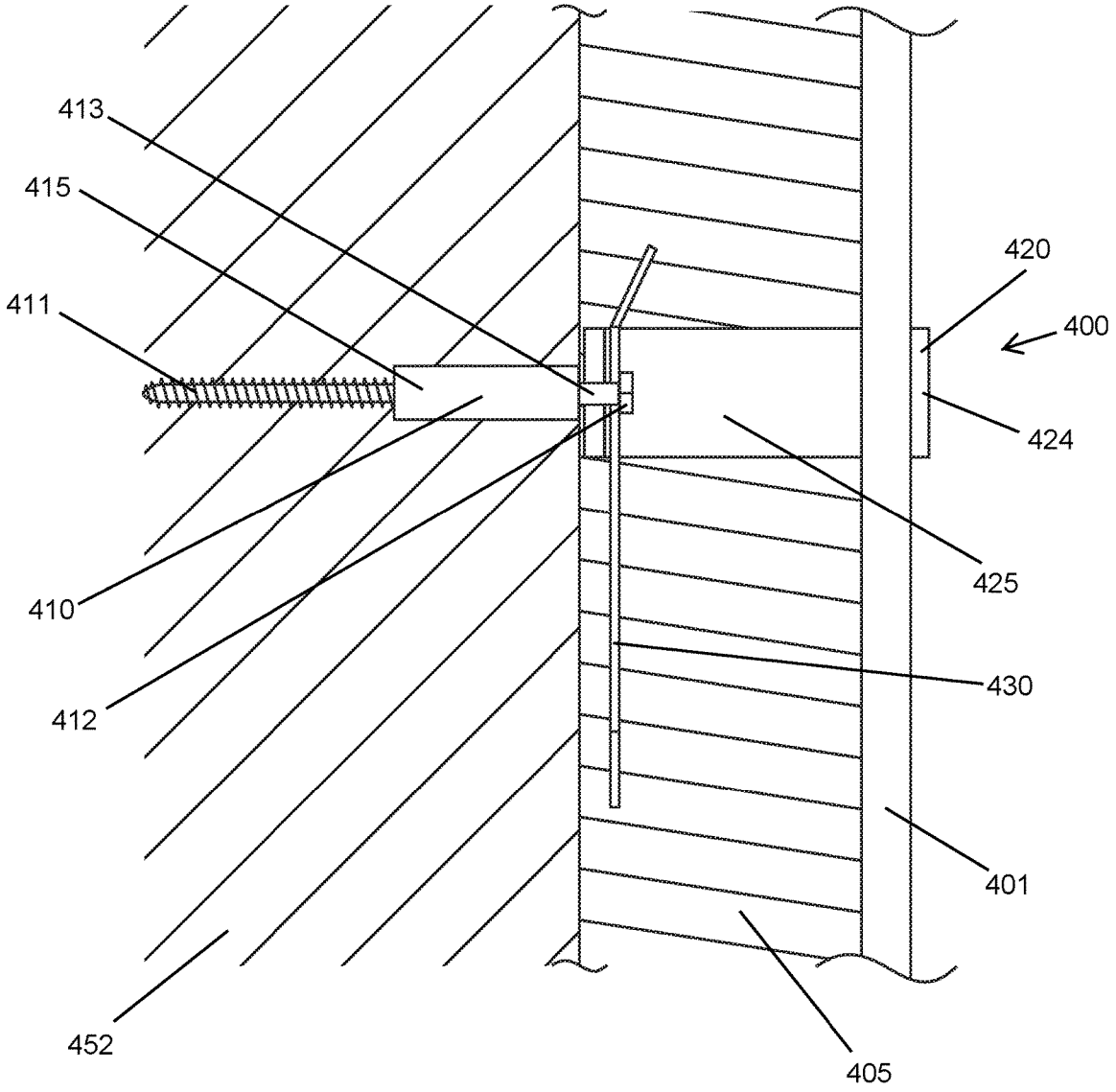
FIG. 4 depicts a partial cut away view of system 400.

FIG. 4 depicts a partial cut away view of system 400. System 400 comprises anchor bolt 410, resilient strap 420, and bracket 430, all of which hold panel 401 over the frame 405 of a window (otherwise not seen). Window frame 405 protrudes beyond wall 452, which makes it difficult to protect the window without Applicant's system 400. Anchor bolt 410 comprises threaded shaft 411 anchored into wall 452, head 412 having an axial stem 413, and a reciprocating chamber 415 embracing the axial stem 413 and connecting head 412 to threaded shaft 411. Resilient strap 420 comprises panel support portion 424 which is connected by extension portion 425 to a bolt engagement opening (not seen; in the vicinity of axial shaft 413). Bracket 430 secures resilient strap 420 to anchor bolt 410.

Figure 5:
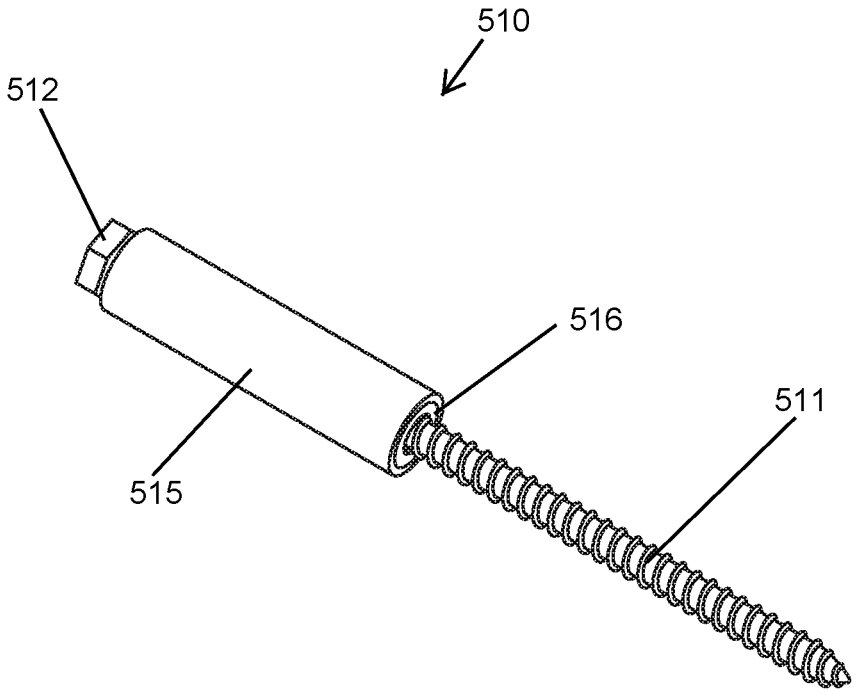
FIGS. 5, 6, and 7 depict anchor bolt 510.
Figure 6:
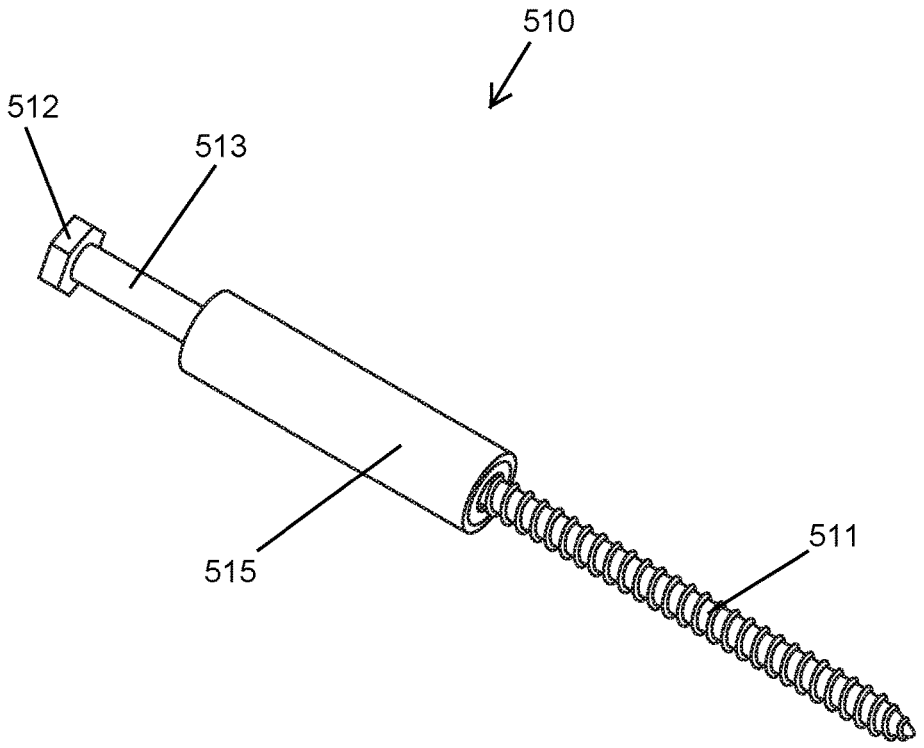
Figure 7:
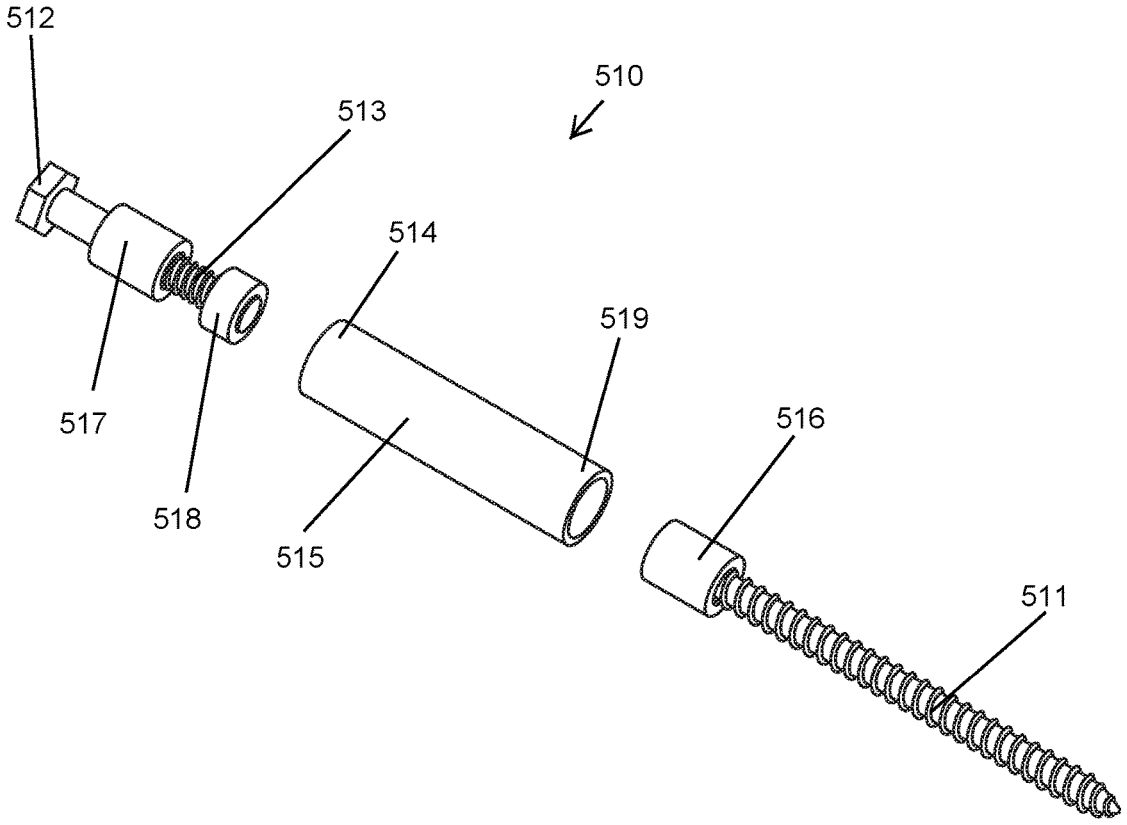

FIGS. 5, 6, and 7 depict anchor bolt 510. Anchor bolt 510 comprises threaded shaft 511 for anchoring into a wall, head 512 having axial stem 513, and a reciprocating chamber 515 embracing axial stem 513 and connecting head 512 to the threaded shaft 511. The end of axial shaft 513 farthest from head 512 contains nut 518, which holds axial shaft inside smooth bushing 517. During manufacture, axial shaft 513 is inserted into smooth bushing 517, nut 518 is added, and smooth bushing 517 is inserted into reciprocating chamber 515 at first end 514, which is then crimped. To attach threaded shaft 511, threaded bushing 516 is secured to threaded shaft 511 and inserted into second end 519 of reciprocating chamber 515, which is then crimped. As shown by comparing FIGS. 5 and 6, axial shaft 513 can slide in and out of reciprocating chamber 515, allowing head 512 to retract to a wall when anchor bolt 510 is not in use.

Figure 8:
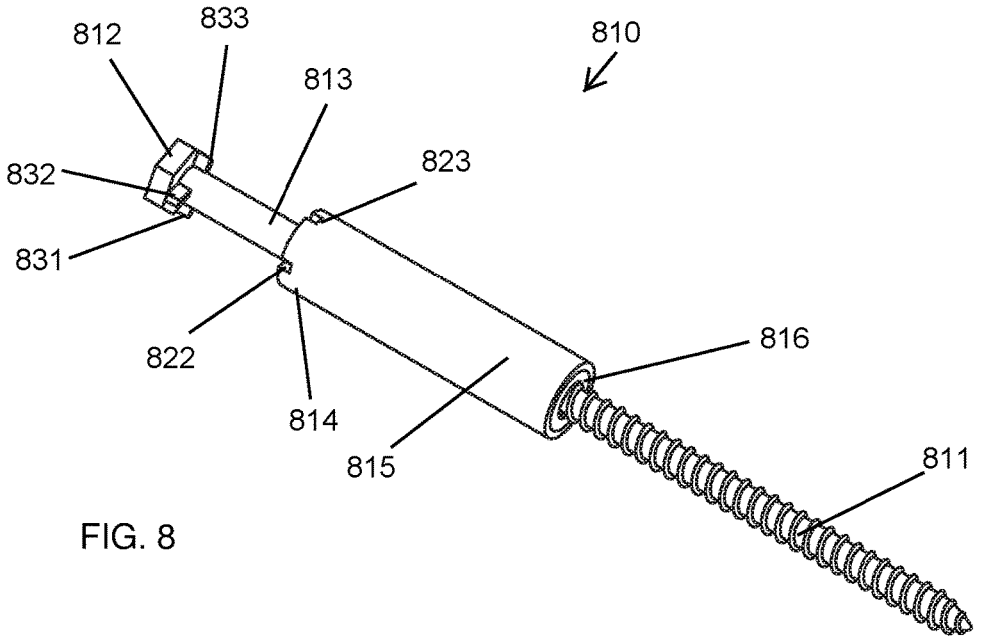
FIGS. 8 and 9 depict anchor bolt 810.
Figure 9:
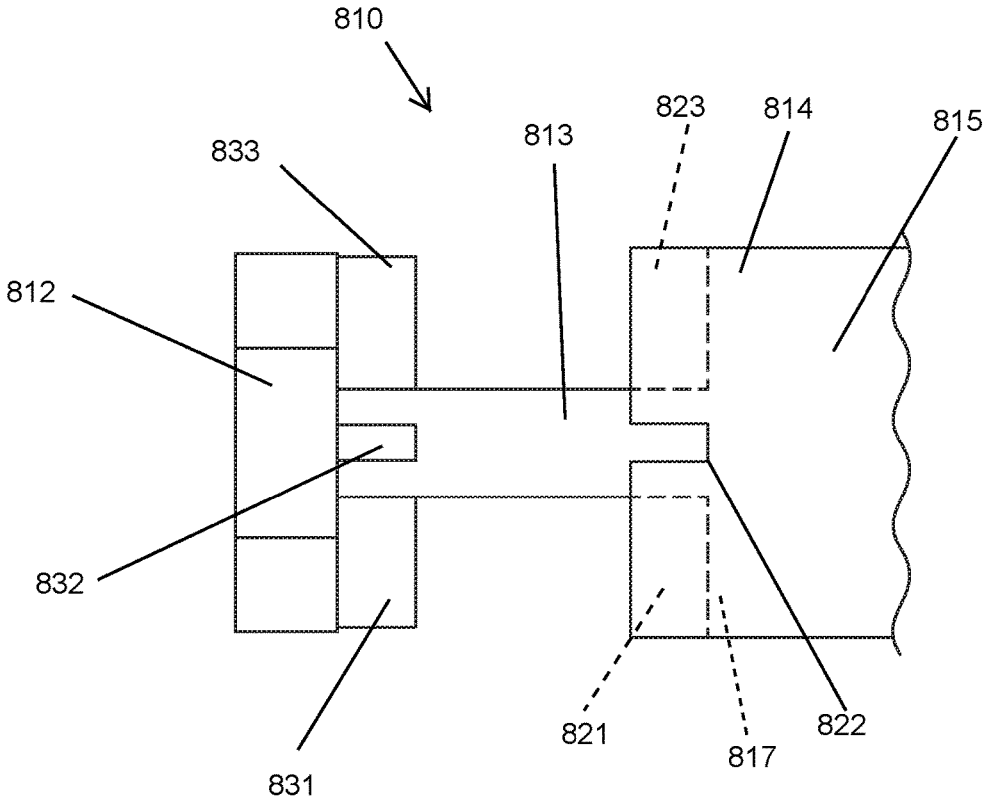

FIGS. 8 and 9 depict anchor bolt 810. Anchor bolt 810 comprises threaded shaft 811 for anchoring into a wall, head 812 having axial stem 813, and a reciprocating chamber 815 embracing axial stem 813 and connecting head 812 to the threaded shaft 811. Head 812 comprises engagement fins 831, 832, 833 adapted to engage engagement recesses 822, 823 (and others not seen) in smooth bushing 817 in first end 814 of reciprocating chamber 815, so that when engagement fins 831, 832, 833 engage the engagement recesses 821, 822, turning the head 812 ultimately turns threaded shaft 811. This allows one to turn head 812 with a socket wrench, for example, and install or remove anchor bolt 810 from a wall.

Figure 10:
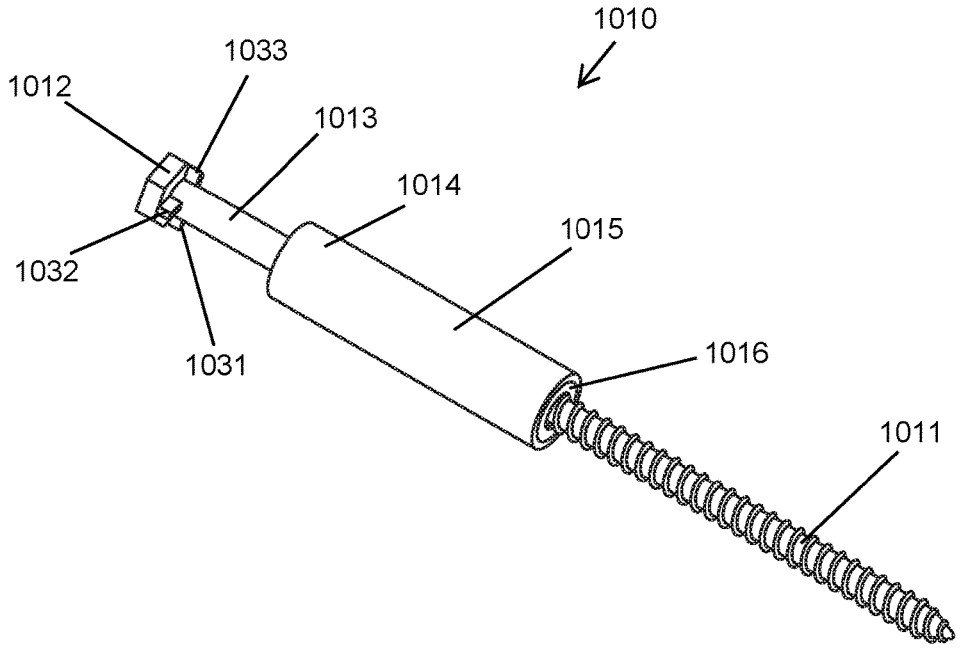
FIG. 10 depicts anchor bolt 1010.

FIG. 10 depicts anchor bolt 1010. Here, reciprocating chamber 1015 is wider than engagement fins 1031, 1032, 1033, so no engagement recesses are visible in first end 1014 of reciprocating chamber 1015. Engagement recesses exist in a smooth bushing (not visible) in first end 1014 of reciprocating chamber 1015. Anchor bolt 1010 comprises threaded shaft 1011, which is held in reciprocating chamber 1015 by threaded bushing 1016; head 1012 has axial shaft 1013, which can slide in and out of reciprocating chamber 1015.

Figure 11:
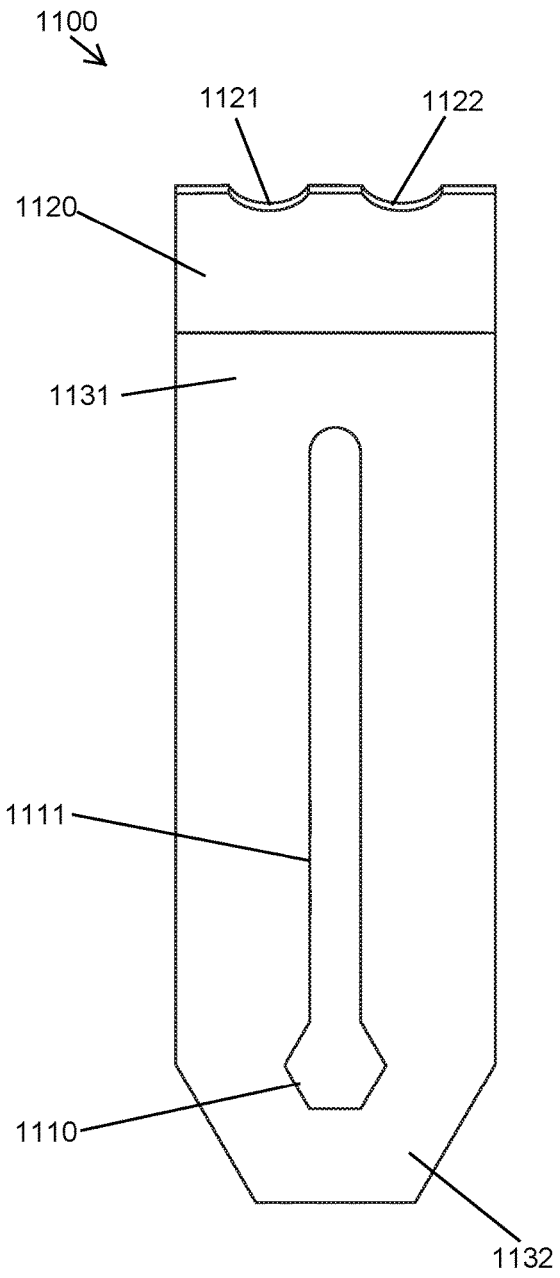
FIGS. 11, 12, 13, 14, 15, 16, and 17 depict bracket 1100.
Figure 12:
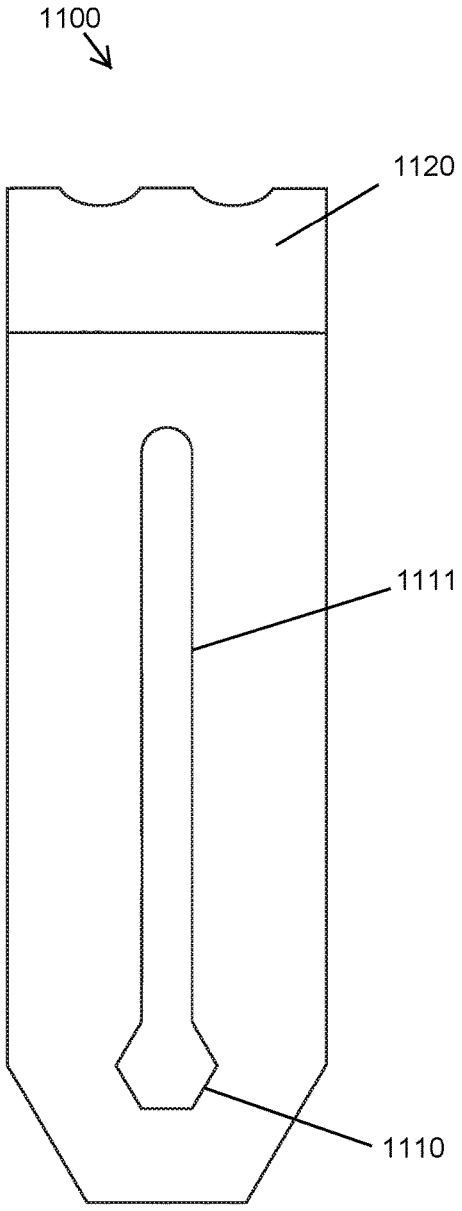
Figure 13:
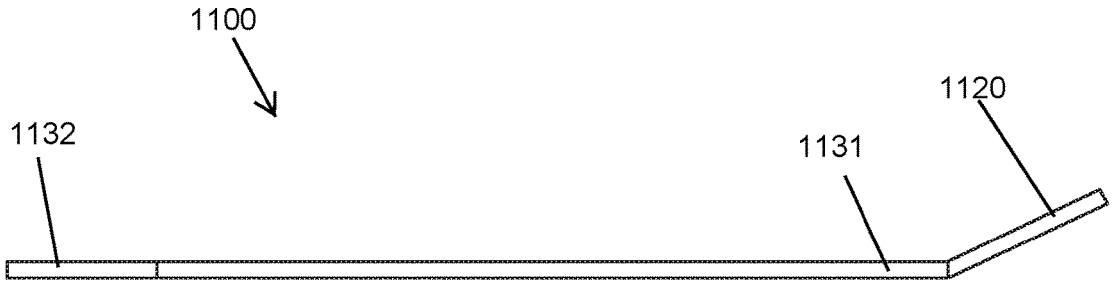
Figure 14:
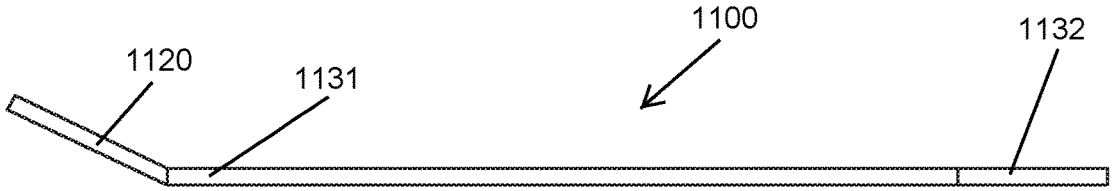
Figure 15:
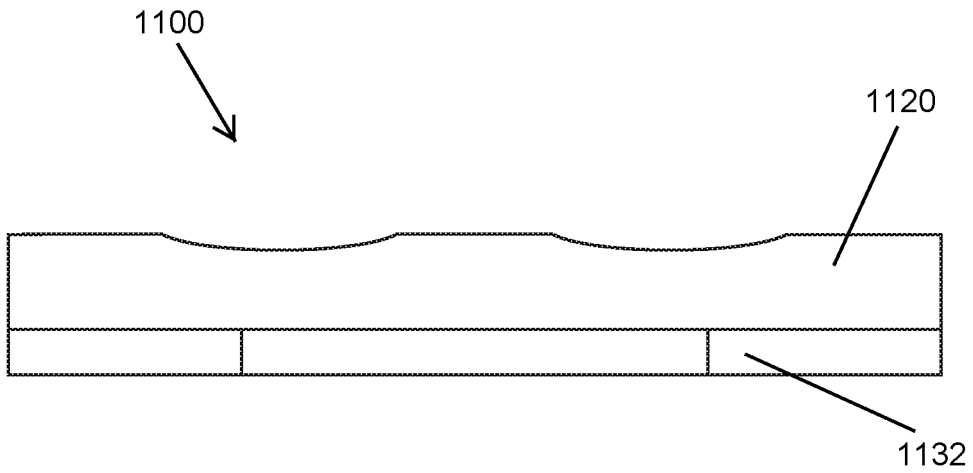
Figure 16:
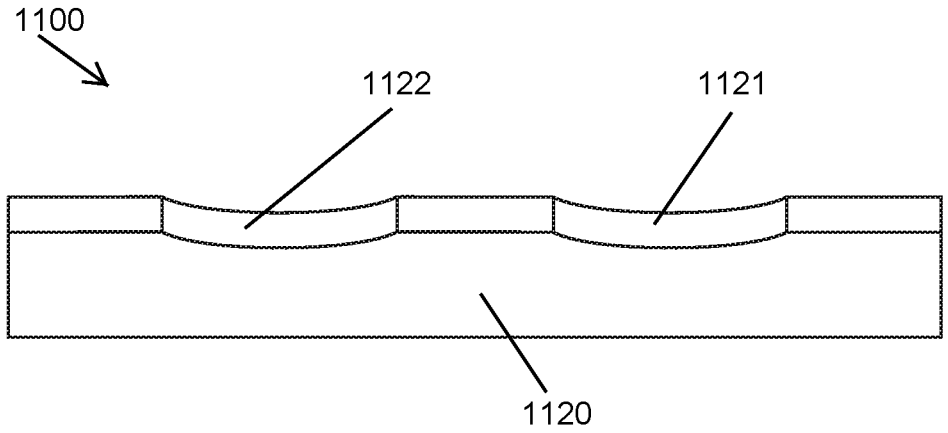
Figure 17:
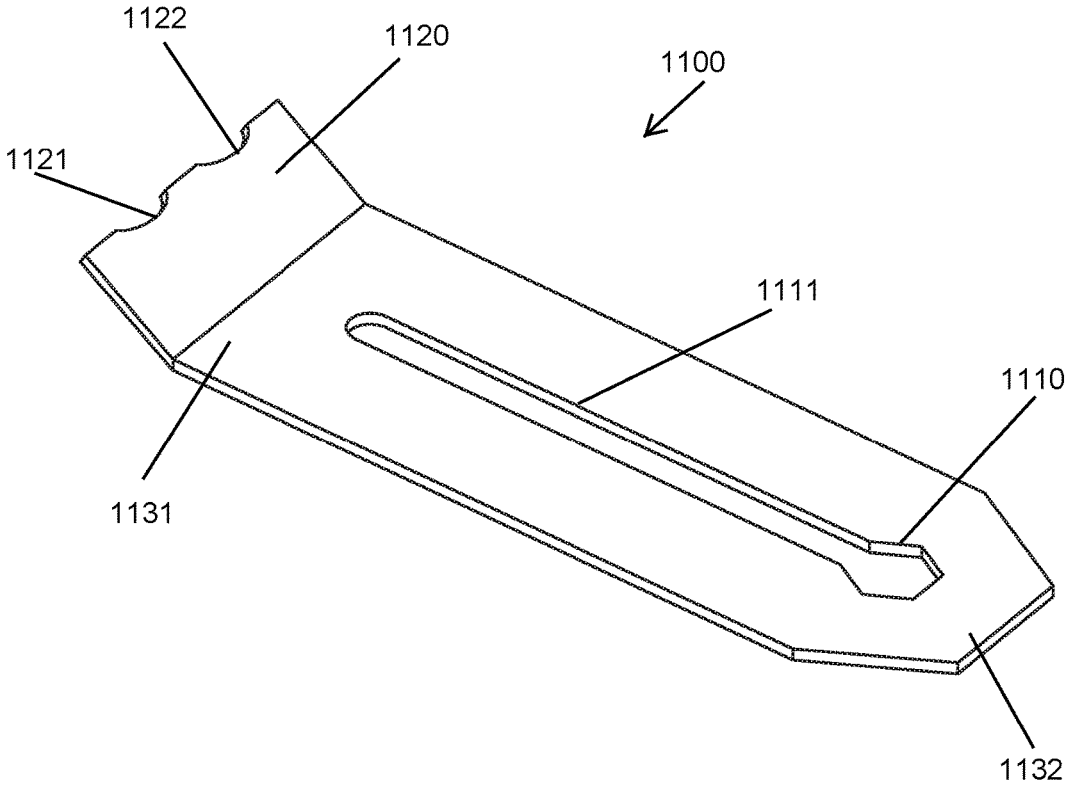

FIGS. 11, 12, 13, 14, 15, 16, and 17 depict bracket 1100. Bracket 1100 comprises aperture 1110 near lower end 1132 for receiving a head of a bolt (not shown), and slot 1111 extending from aperture 1110 toward upper end 1131. Slot 1111 is narrower than the head of a bolt, but wider than a shaft of the bolt. Bracket 1100 is substantially flat, and has a substantially rectangular shape, in that when a bolt head is inserted in aperture 1110 and slid along the slot 1111, the substantially rectangular shape of bracket 1100 and its weight will help keep the head of the bolt from exiting aperture 1110. Bracket 1100 further comprises a fingerhold 1120 at upper end 1131, which further comprises structures for receiving one or more fingers, which are finger divots 1121, 1122. FIG. 11 is a front elevation view; FIG. 12 is a back elevation view. FIG. 13 is a view of the left side; FIG. 14 is a view of the right side; FIG. 15 is a bottom plan view; and FIG. 16 is a top plan view, all rotated 90 degrees. FIG. 17 is a perspective view of bracket 1100.

Figure 18:
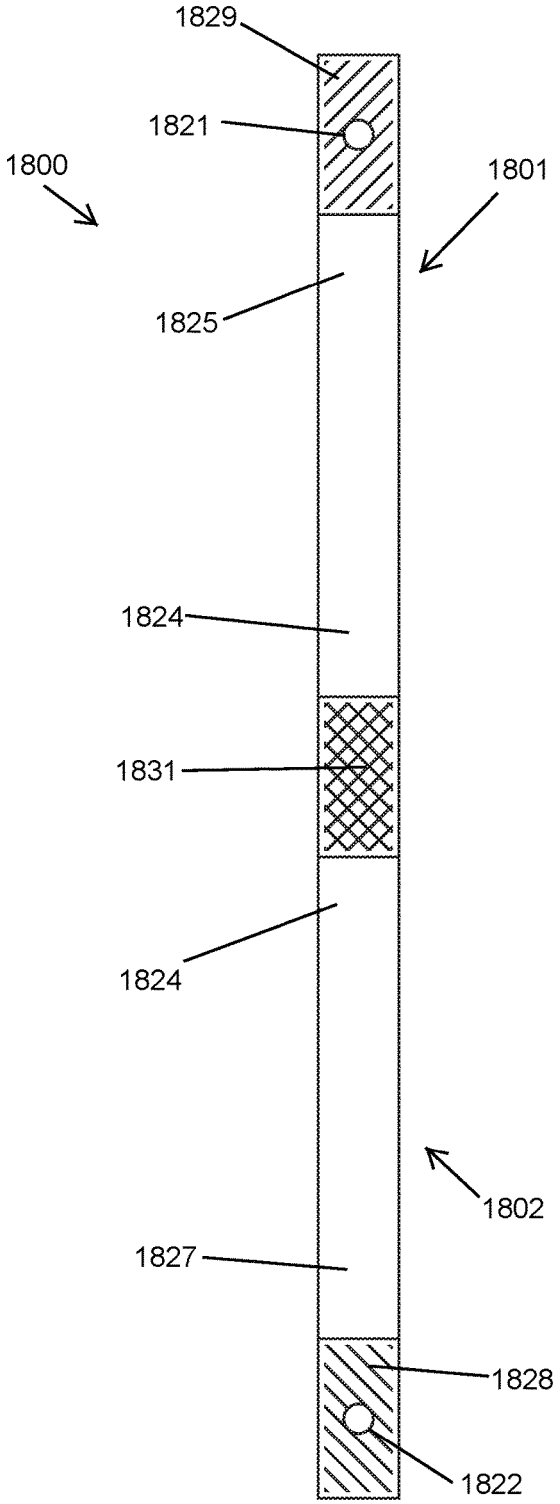
FIGS. 18 and 20 depict resilient strap 1800 made from half-straps 1801, 1802.
Figure 20:
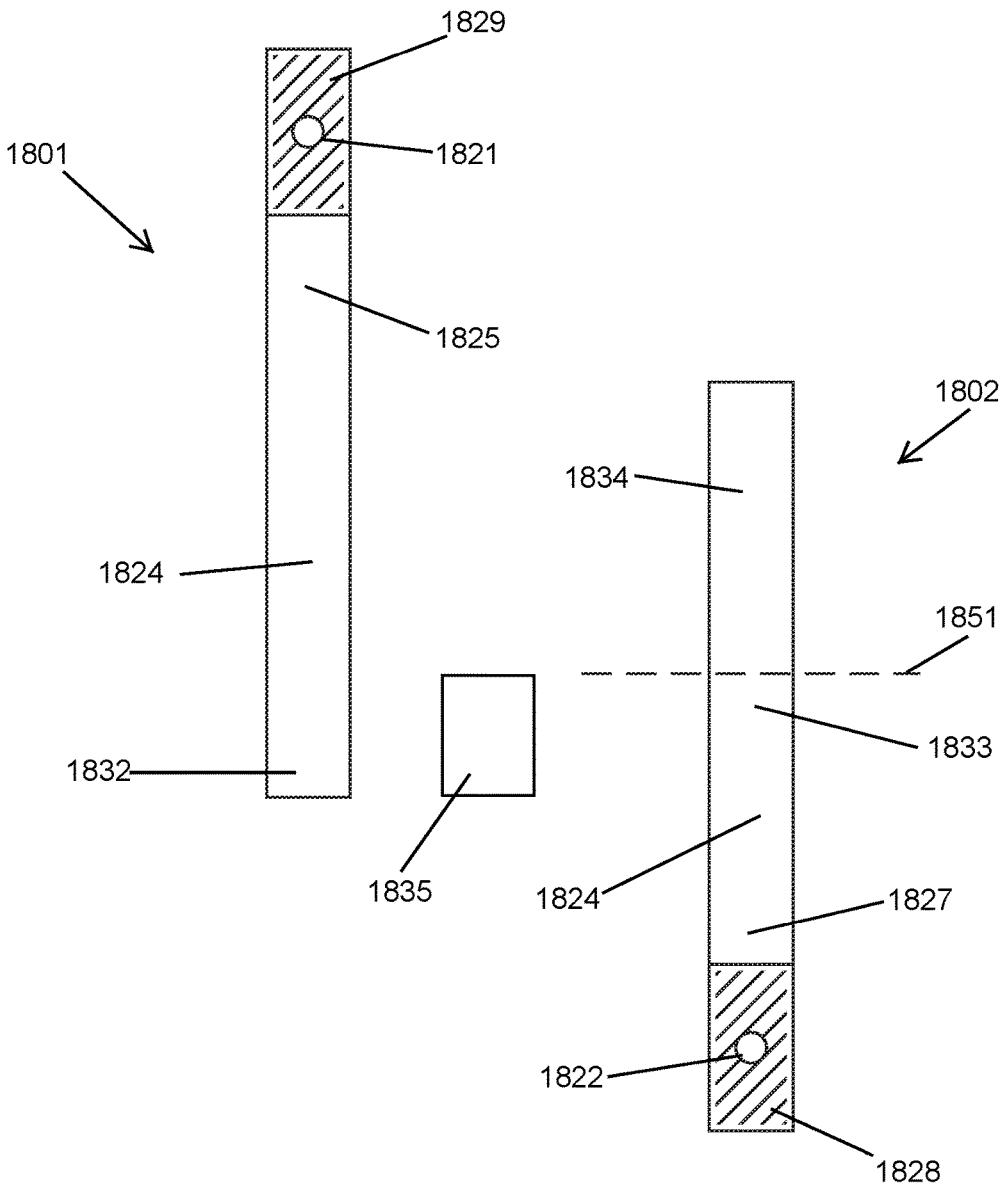

FIGS. 18 and 20 depict resilient strap 1800 made from half-straps 1801, 1802. Resilient strap 1800 comprises first bolt engagement opening 1821 for receiving a head of a bolt (not shown), panel support portion 1824, first extension portion 1825 joining first bolt engagement opening 1821 to the panel support portion 1824, second bolt engagement opening 1822 for receiving the head of another bolt (also not shown), and second extension portion 1827 for joining a second bolt engagement opening 1822 to the panel support portion 1824. First bolt engagement opening 1821 is formed by making a hole in a rectangular piece of metal or sturdy plastic 1829, which is then attached to the first half-strap 1801. Any suitable method of attachment can be used, such as, for example melting, crimping, adhering, or combinations thereof. Second bolt engagement opening 1822 is formed by making a hole in a rectangular piece of metal or sturdy plastic 1828 which is then attached to the second half strap 1802. When installing a system using resilient strap 1800, half-straps 1801, 1802 are supplied to the installer. Then, the installer can measure exactly how long resilient strap 1800 needs to be, and, for example cut second half strap 1802 at line 1851, removing excess 1834. Half-straps 1801, 1802 are overlaid at the first panel support portion 1832 and a second panel support portion 1833, respectively, and crimped or otherwise connected to form linking region 1831, thereby completing resilient strap 1800. Optionally, linking region 1831 can include a splice or seal piece 1835. Any suitable material can be used for piece 1835, such as pieces or sleeves currently used for splicing or sealing the material of half-straps 1801, 1802. Care should be taken so that linking region 1831 is not too close to a strap slot in a panel, for example.

Figure 19:
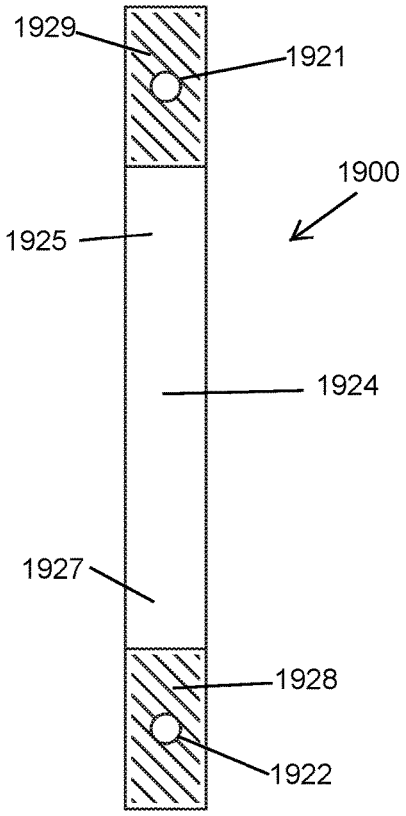
FIGS. 19 and 27 depict resilient strap 1900.
Figure 27:
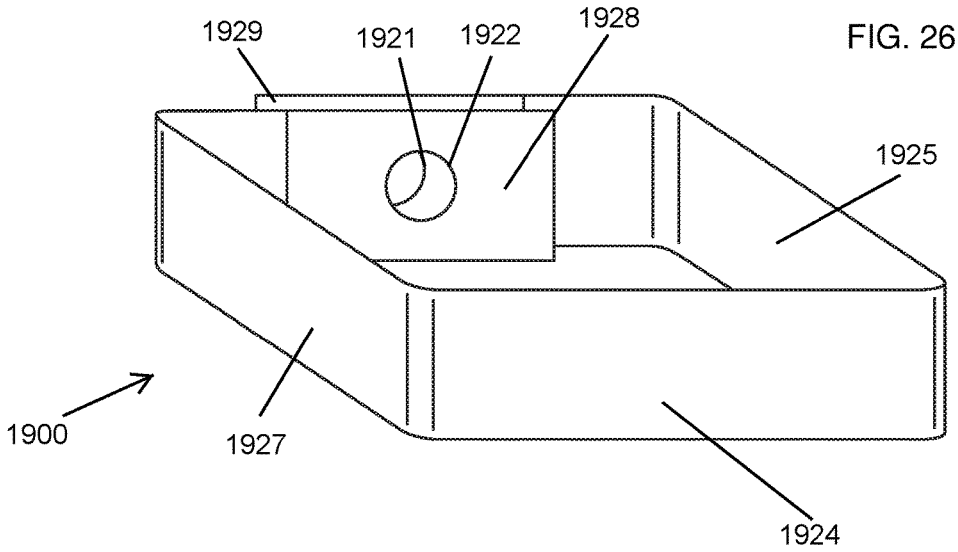

FIGS. 19 and 27 depict resilient strap 1900. Resilient strap 1900 comprises a first bolt engagement opening 1921 for receiving a head of a bolt (not shown), panel support portion 1924 first extension portion 1925 joining first bolt engagement opening 1921 to panel support portion 1924, second bolt engagement opening 1922 for receiving the head of the same bolt, and a second extension portion 1927 joining the second bolt engagement opening 1922 to panel support portion 1924. First bolt engagement opening 1921 is made by forming a hole in a rectangular piece 1929 of metal or plastic, and then securing piece 1929 to first extension portion 1925. Second bolt engagement opening 1922 is made in a similar fashion using rectangular piece 1928. Resilient strap 1900 can be made of any suitable materials, such as, for example, a sturdy, flexible, woven, or nonwoven polymer as described above. FIG. 19 shows resilient strap 1900 laid flat. FIG. 27 shows resilient strap 1900 as it would be employed in a system supporting a panel (not shown) secured to an anchor bolt (also not shown). It can be seen that first bolt engagement opening 1921 is aligned with second bolt engagement opening 1922.

Figure 21:
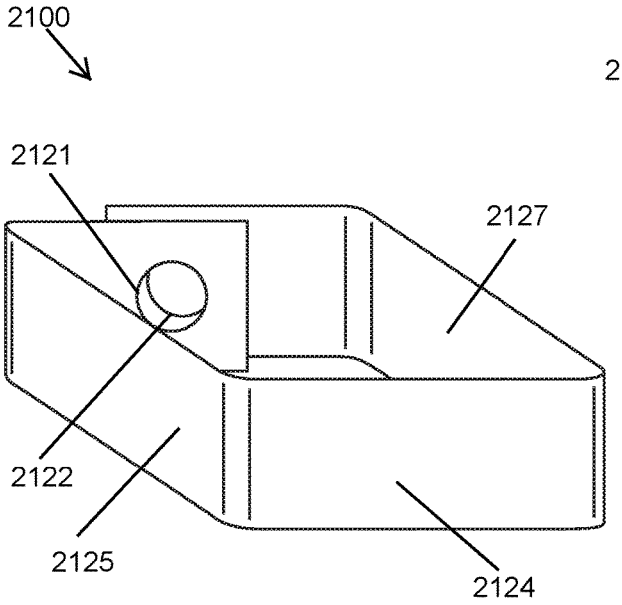
FIGS. 21 and 22 depict resilient strap 2100.
Figure 22:
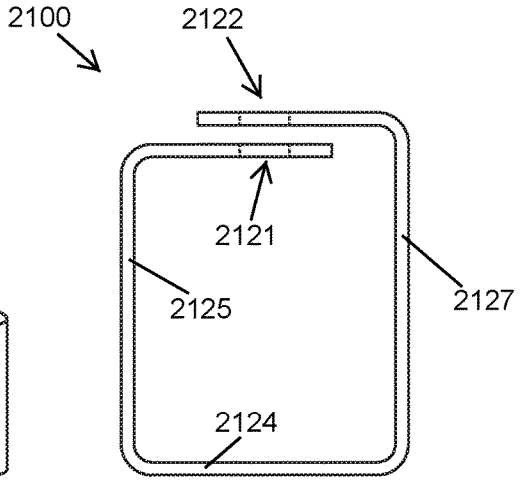

FIGS. 21 and 22 depict resilient strap 2100. FIG. 21 is a perspective view, and FIG. 22 shows a top plan view. Resilient strap 2100 comprises first bolt engagement opening 2121 and second bolt engagement opening 2122, panel support portion 2124, first extension portion 2125 joining first bolt engagement opening 2121 to the panel support portion 2124, and second extension portion 2127 joining the second bolt engagement opening 2122 to the panel support portion 2124. Resilient strap 2100 is made of any suitable material, such as, for example, high tensile strength steel. It must be appreciated that the material must be rigid enough to support a panel, but flexible enough to be fed through adjacent strap slots on that panel without damaging resilient strap 2100. Resilient strap 2100 can be used with a panel having strap slots relatively close together, such as, for example, panel 301 having strap slots 340, 341, as shown in FIG. 3.

Figure 23:
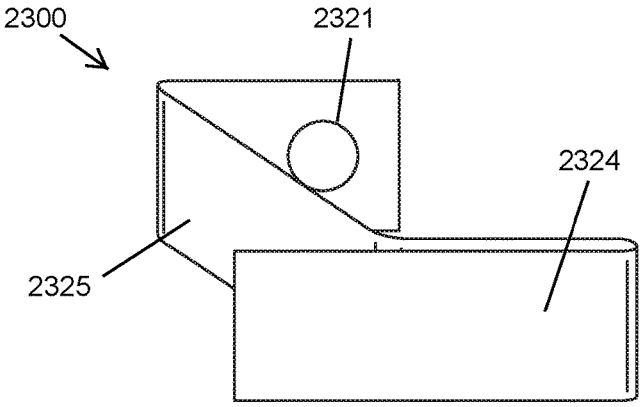
FIGS. 23 and 24 depict resilient strap 2300.
Figure 24:
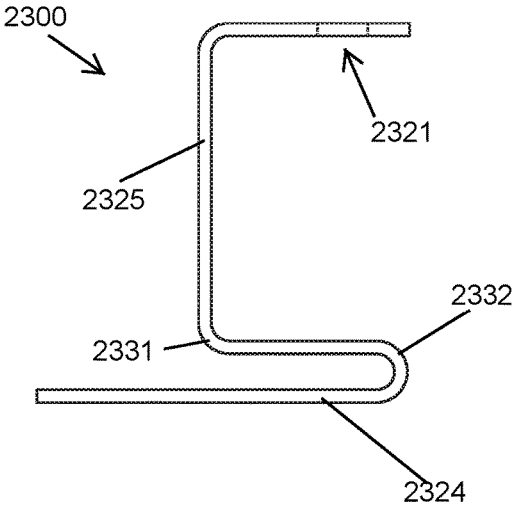

FIGS. 23 and 24 depict resilient strap 2300. FIG. 23 is a perspective view, and FIG. 24 shows a top plan view. Resilient strap 2300 comprises bolt engagement opening 2321, which is connected via extension portion 2325 to panel support portion 2324. Resilient strap 2300 could be used with a panel having only one strap slot in the vicinity of an anchor bolt, such as, for example, strap slot 140 as seen in FIGS. 1 and 2. Resilient strap 2300 could be positioned so that either bend 2331 or bend 2332 can engage strap slot 140. Resilient strap 2300 is made of any suitable material, such as, for example, high tensile strength steel.

Figure 25:
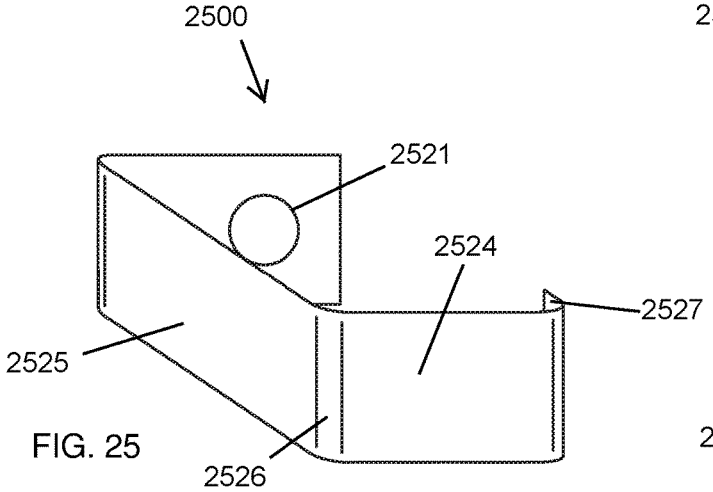
FIGS. 25 and 26 depict resilient strap 2500.
Figure 26:
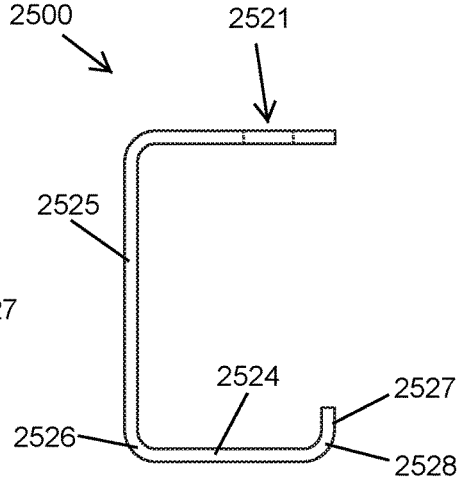

FIGS. 25 and 26 depict resilient strap 2500. FIG. 25 is a perspective view, and FIG. 26 shows a top plan view. Resilient strap 2500 comprises bolt engagement opening 2521, which is connected via extension portion 2525 to panel support portion 2524. Resilient strap 2500 further comprises tongue 2527, which allows resilient strap 2500 to engage two adjacent strap slots, such as, for example, strap slots 340, 341 in panel 301 as shown in FIG. 3. Bend 2526 would position in the proximity of strap slot 340, and bend 2528 would position in the proximity of strap slot 341, for example.

Figure 28:
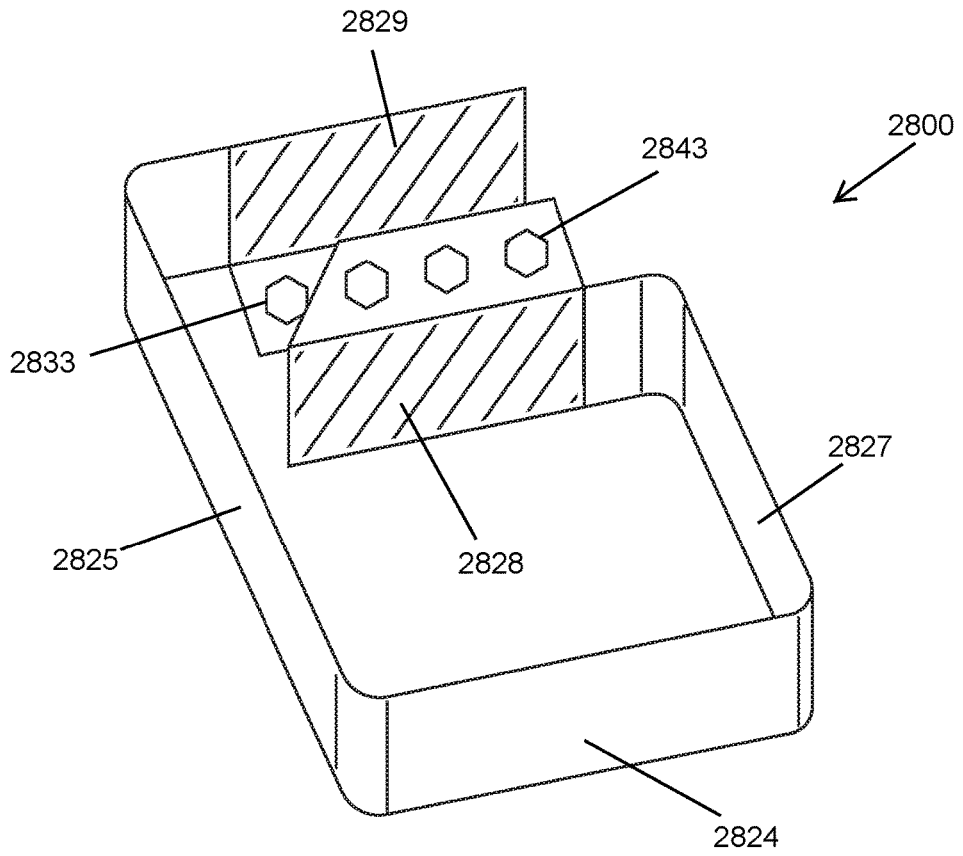
FIGS. 28 and 29 depict resilient strap 2800.
Figure 29:
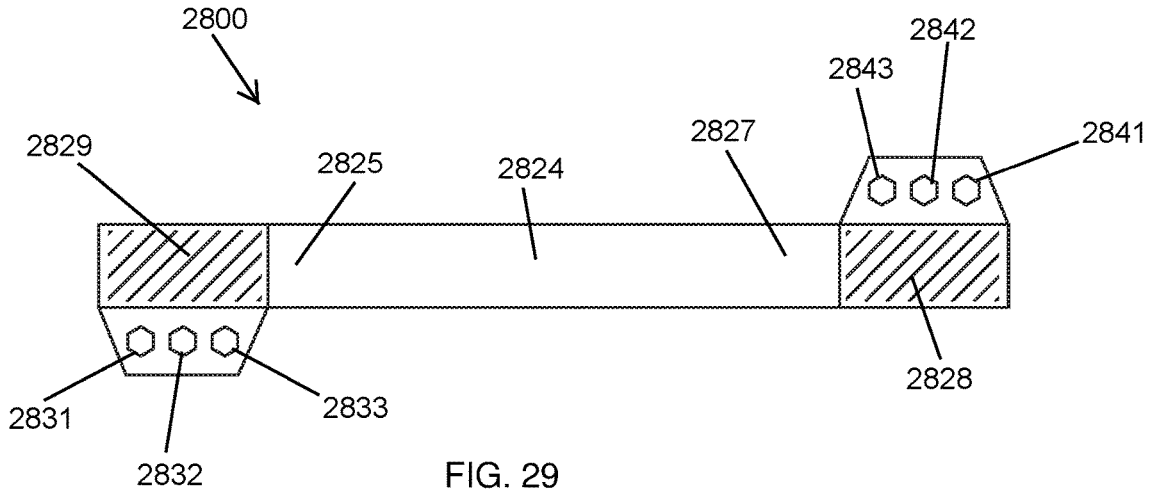

FIGS. 28 and 29 depict resilient strap 2800. Resilient strap 2800 comprises a plurality of first bolt engagement openings 2831, 2832, 2833, and a plurality of second bolt engagement openings 2841, 2842, 2843. The plurality of first bolt engagement openings 2831, 2832, 2833 are formed in piece 2829, which is made of any suitable material such as, for example, metal or sturdy polymer. Similarly, the plurality of second bolt engagement openings 2841, 2842, 2843 are formed in piece 2828, which is made of any suitable material such as, for example, metal or sturdy polymer. Then, pieces 2828, 2829 are attached to extension portions 2827, 2025, respectively, which both join to panel support portion 2824. Any suitable method of attaching pieces 2828 and 2829 can be used, such as, for example, melting, crimping, adhering, or a combination thereof. Resilient strap 2800 can be used with a panel having two adjacent strap slots, such as, for example, panel 301 appearing in FIG. 3. To accommodate slight variations in dimensions, when installing such a panel, resilient strap 2800 can be fed through adjacent strap slots, and then any one of first bolt engagement openings 2831, 2832, and 2833 can be passed over the head of an anchor bolt. Then, so that any slack in resilient strap 2800 is taken up, any one of second bolt engagement openings 2841, 2842, 2843 can be passed over the head of the anchor bolt, and then secured by a bracket as described herein.

Figure 30:
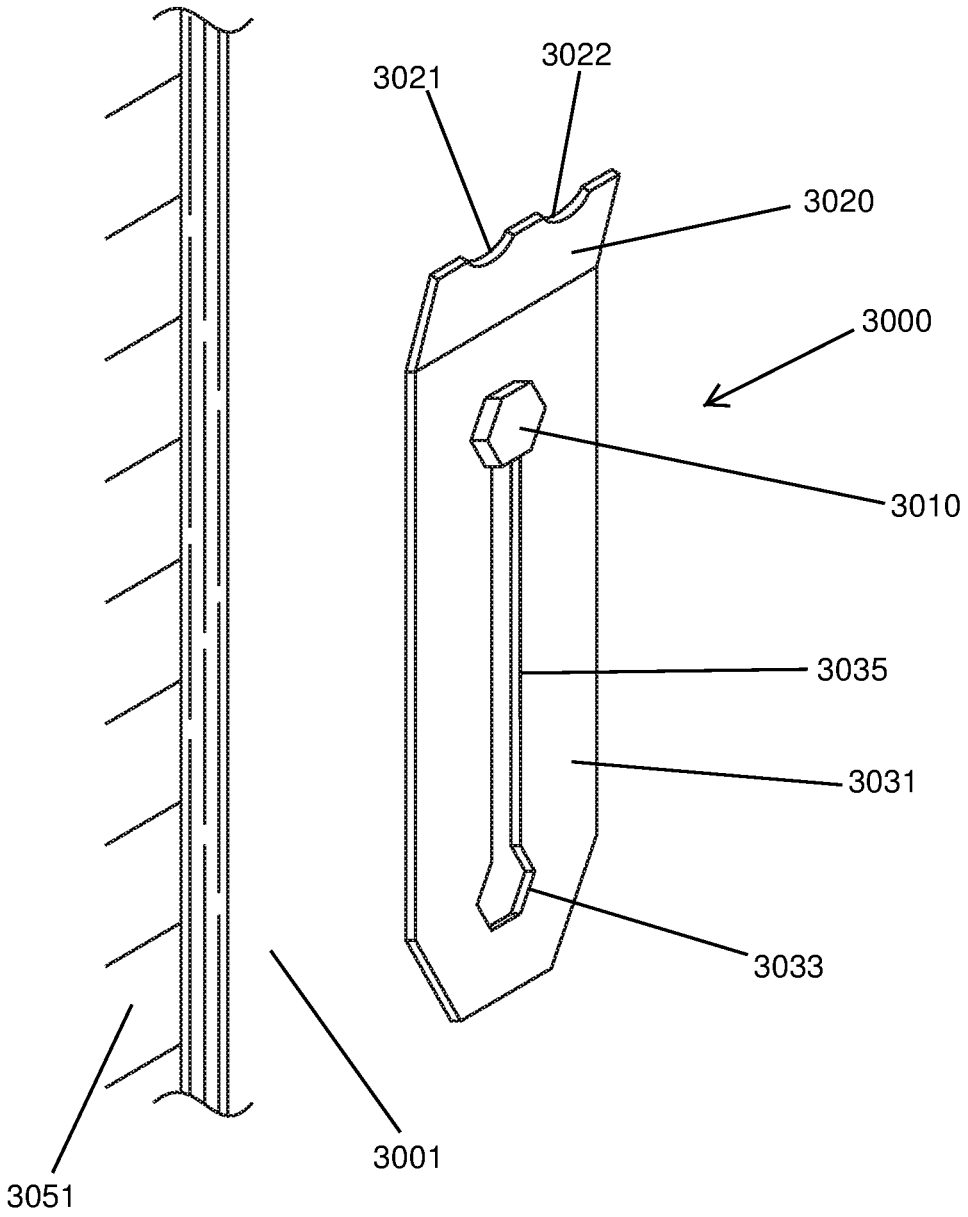
FIG. 30 depicts system 3000 holding panel 3001 to wall 3051 without the use of a resilient strap.

FIG. 30 depicts system 3000 holding a panel 3001 to wall 3051 without the use of a resilient strap. Here, the opening being protected (not seen) does not protrude away from wall 3051, so no resilient strap is necessary. Anchor bolt 3010 is anchored into wall 3051 adjacent to the opening, and comprises a head connecting to a shaft (not seen). Anchor bolt can be like any of the anchor bolts described herein, such as, for example, anchor bolts 410, 510, 810, or 1010. Bracket 3031 secures panel 3001 to the head of anchor bolt 3010, and comprises aperture 3033 for receiving the head of anchor bolt 3010. Slot 3035 extends from the aperture 3033, and is wider than the shaft of anchor bolt 3010. Optionally, anchor bolt 3010 or a portion thereof is adapted to retract into wall 3051, and is permanently anchored therein. Bracket 3031 is substantially flat, since slot 3035 has no slope. Bracket 3031 further comprises fingerhold 3020, which has structures for receiving fingers in the form of finger divots 3021, 3022.

Figure 31:
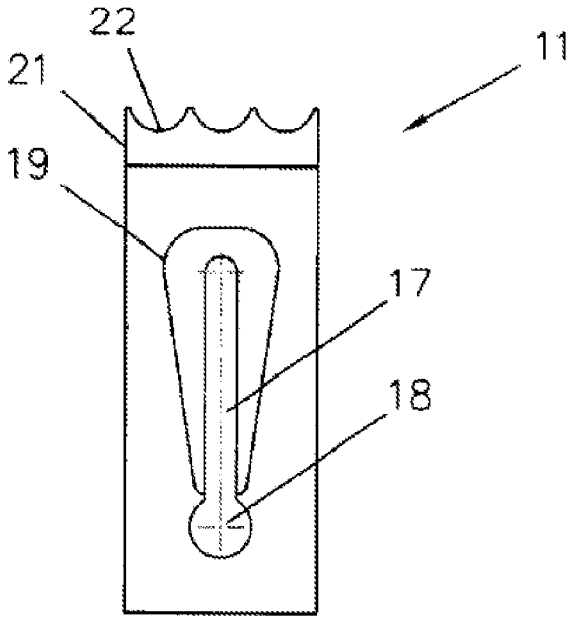
FIG. 31 is an elevational view of the front of bracket 11 having a slope 19.
Figure 32:
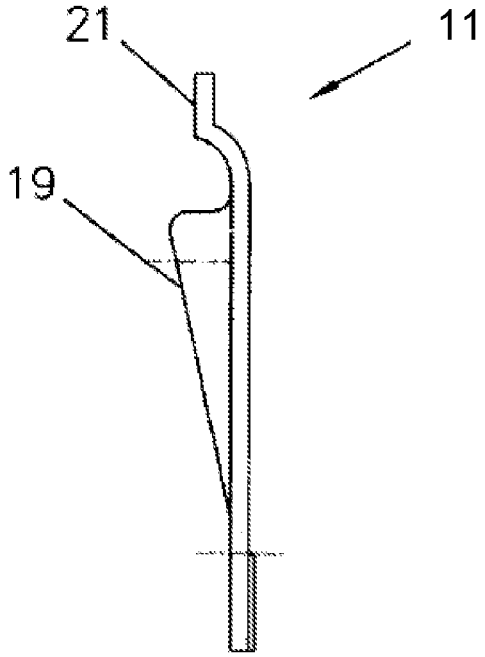
FIG. 32 is an elevational view of a side of bracket 11 according to FIG. 31.

FIGS. 31 and 32 depict a bracket 11 comprising aperture 18 for receiving a head of a bolt (not shown), and slot 17 extending from aperture 18. Bracket 11 further comprises a fingerhold 21, which further comprises structures for receiving one or more fingers, such as finger divot 22. Bracket 11 comprises a slope 19 increasing from aperture 18 along slot 17.

EMBODIMENTS

Embodiment 1

A system for protecting an opening from high wind and wind-borne debris, comprising:

an anchor bolt adapted for anchoring into a wall adjacent to the opening, comprising a head connecting a shaft;

a resilient strap adapted to support a panel, the resilient strap comprising at least one bolt engagement opening for receiving the head of the anchor bolt, a panel support portion, and at least one extension portion joining the at least one bolt engagement opening to the panel support portion;

a bracket for securing the resilient strap to the head of the anchor bolt, the bracket comprising an aperture for receiving the head of the anchor bolt and a slot extending from the aperture for securing the resilient strap to the anchor bolt.

Embodiment 2

The system of embodiment 1, wherein the opening is a window or a door.

Embodiment 3

The system of any one of embodiments 1-2, wherein the opening protrudes beyond the wall adjacent to the opening.

Embodiment 4

The system of any one of embodiments 1-3, wherein the anchor bolt is adapted to be permanently anchored into the wall adjacent to the opening.

Embodiment 5

The system of any one of embodiments 1-3, wherein the anchor bolt or a portion thereof is adapted to be removed from the wall adjacent to the opening when there is no need to protect the opening.

Embodiment 6

The system of any one of embodiments 1-3, wherein the anchor bolt or a portion thereof is adapted to retract into the wall adjacent to the opening when there is no need to protect the opening, and the anchor bolt is adapted to be permanently anchored into the wall adjacent to the opening.

Embodiment 7

The system of embodiment 6, wherein:
the head connects the shaft via a reciprocating chamber joining the head to the shaft.

Embodiment 8

The system of any one of embodiments 1-7, wherein the resilient strap comprises high tensile strength steel, polymer, or a combination thereof.

Embodiment 9

The system of any one of embodiments 1-8, wherein
the at least one bolt engagement opening comprises a first bolt engagement opening, and a second bolt engagement opening; and
the at least one extension portion comprises a first extension portion joining the first bolt engagement opening to the panel support portion, and a second extension portion joining the second bolt engagement opening to the panel support portion.

Embodiment 10

The system of any one of embodiments 1-9, wherein the bracket is substantially flat.

Embodiment 11

The system of any one of embodiments 1-9, wherein the bracket comprises a slope increasing from the aperture along the slot.

Embodiment 12

The system of any one of embodiments 1-11, wherein the slot has a width that is less than the head of the bolt but greater than the width of the shaft.

Embodiment 13

The system of any one of embodiments 1-12, wherein:
the shaft comprises a threaded shaft for anchoring into a wall; the head further comprises an axial stem; and
the anchor bolt further comprises a reciprocating chamber embracing the axial stem and connecting the head to the threaded shaft.

Embodiment 14

The system of embodiment 13, wherein the reciprocating chamber comprises a threaded bushing for connecting the threaded shaft.

Embodiment 15

The system of any one of embodiments 13-14, wherein the reciprocating chamber comprises a smooth bushing for embracing the axial stem.

Embodiment 16

The system of embodiment 15, wherein the smooth bushing comprises one or more engagement recesses proximal to the head, and
the head comprises, proximal to the smooth bushing, one or more engagement fins adapted to engage the one or more engagement recesses so that when the one or more engagement fins engages the one or more engagement recesses, turning the head turns the smooth bushing and the threaded shaft.

Embodiment 17

The system of any one of embodiments 14-16, wherein the reciprocating chamber and the threaded bushing are made from a single piece.

Embodiment 18

The system of any one of embodiments 14-17, wherein the reciprocating chamber and the smooth bushing are made from a single piece.

Embodiment 19

An anchor bolt for a system for protecting an opening, the anchor bolt comprising:
a threaded shaft for anchoring into a wall;
a head having an axial stem; and
a reciprocating chamber embracing the axial stem and connecting the head to the threaded shaft.

Embodiment 20

The anchor bolt of embodiment 19, wherein the reciprocating chamber comprises a threaded bushing for connecting the threaded shaft.

Embodiment 21

The anchor bolt of any one of embodiments 19-20, wherein the reciprocating chamber comprises a smooth bushing for embracing the axial stem.

Embodiment 22

The anchor bolt of embodiment 21, wherein
the smooth bushing comprises one or more engagement recesses proximal to the head, and
the head comprises, proximal to the smooth bushing, one or more engagement fins adapted to engage the one or more engagement recesses so that when the one or more engagement fins engages the one or more engagement recesses, turning the head turns the smooth bushing and the threaded shaft.

Embodiment 23

The anchor bolt of any one of embodiments 20-22, wherein the reciprocating chamber and the threaded bushing are made from a single piece.

Embodiment 24

The anchor bolt of any one of embodiments 20-23, wherein the reciprocating chamber and the smooth bushing are made from a single piece.

Embodiment 25

A bracket for a system for protecting an opening, the bracket comprising:

an aperture for receiving a head of a bolt; and
a slot extending from the aperture, wherein the slot is narrower than the head of the bolt but wider than a shaft of the bolt.

Embodiment 26

The bracket of embodiment 25, wherein the bracket is substantially flat.

Embodiment 27

The bracket of embodiment 25, wherein the bracket comprises a slope increasing from the aperture along the slot.

Embodiment 28

The bracket of any one of embodiments 25-27, wherein the bracket has a rectangular shape.

Embodiment 29

The bracket of any one of embodiments 25-28, wherein the bracket comprises steel, aluminum, a structural polymer, or a combination thereof.

Embodiment 30

The bracket of any one of embodiments 25-29, further comprising a fingerhold, comprising one or more structures for receiving one or more fingers.

Embodiment 31

A resilient strap for a system for protecting an opening, the resilient strap comprising:
a first bolt engagement opening for receiving a head of a bolt;
a panel support portion; and
a first extension portion joining the first bolt engagement opening to the panel support portion.

Embodiment 32

The resilient strap of embodiment 31, wherein the resilient strap comprises high tensile strength steel, polymer, or a combination thereof.

Embodiment 33

The resilient strap of any one of embodiments 31-32, further comprising:
a second bolt engagement opening; and
a second extension portion connecting the second bolt engagement opening to the panel support portion.

Embodiment 34

The resilient strap of embodiment 33, wherein the panel support portion comprises a linking region that connects a first panel support portion that joins the first extension portion, and a second panel support portion that joins the second extension portion.

Embodiment 35

The resilient strap of embodiment 34, wherein the linking region is formed by melting, crimping, adhering, or a combination thereof the first panel support portion with the second panel support portion.

Embodiment 36

The resilient strap of any one of embodiments 31-35, wherein the first bolt engagement opening comprises a plurality of first bolt engagement openings.

Embodiment 37

The resilient strap of any one of embodiments 33-36, wherein the second bolt engagement opening comprises a plurality of second bolt engagement openings.

Embodiment 38

A method of protecting an opening from high wind and wind-borne debris, comprising:
obtaining a panel having a plurality of strap slots therein;
attaching a resilient strap to the panel by feeding the resilient strap through a strap slot in the plurality of strap slots, the resilient strap comprising a bolt engagement opening for receiving the head of an anchor bolt, a panel support portion, and an extension portion joining the bolt engagement opening to the panel support portion;
engaging an anchor bolt anchored into a wall adjacent to the opening, the anchor bolt comprising a head connecting a shaft, by passing the head into the bolt engagement opening of the resilient strap; and
securing the resilient strap on the anchor bolt by passing the head of the anchor bolt into a bracket comprising an aperture for receiving the head and a slot extending from the aperture, and sliding the bracket so the head enters the slot,
thereby positioning the panel over the opening and thereby protecting an opening from high wind and wind-borne debris.

Embodiment 39

The method of embodiment 38, wherein the plurality of strap slots comprises pairs of strap slots.

Embodiment 40

The method of any one of embodiments 38-39,
wherein the resilient strap comprises a second extension portion joining a second bolt engagement opening to the panel support portion, and
wherein the engaging the anchor bolt further comprises passing the head of the anchor bolt into the second bolt engagement opening.

Embodiment 41

A method of making an anchor bolt, comprising:
obtaining a cylindrical reciprocating chamber having a first end and a second end;
crimping a threaded bushing in the first end;
securing a threaded shaft in the threaded bushing;
placing a head having an axial stem into a smooth bushing, and securing a nut to the axial stem to secure the axial stem in the smooth bushing; and
crimping the smooth bushing in the second end of the cylindrical reciprocating chamber, thereby connecting the head to the threaded shaft via the cylindrical reciprocating chamber, and thereby making the anchor bolt.

Embodiment 42

A system for protecting an opening from high wind and wind-borne debris, comprising:
an anchor bolt adapted for anchoring into a wall adjacent to the opening, comprising a head connecting a shaft; and
a bracket for securing a panel to the head of the anchor bolt, the bracket comprising an aperture for receiving the head of the anchor bolt and a slot extending from the aperture for securing the panel to the anchor bolt.

Embodiment 43

The system of embodiment 42, wherein the anchor bolt or a portion thereof is adapted to retract into the wall adjacent to the opening when there is no need to protect the opening, and the anchor bolt is adapted to be permanently anchored into the wall adjacent to the opening.

Embodiment 44

The system of any one of embodiments 42-43, wherein the bracket is substantially flat.

Embodiment 45

The system of any one of embodiments 42-44, wherein the anchor bolt is the anchor bolt of any one of embodiments 19-24.

Embodiment 46

The system of any one of embodiments 42-45, wherein the bracket is the bracket of any one of embodiments 25-30.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A system for protecting an opening from high wind and wind-borne debris, comprising:
a panel comprising a plurality of strap slots;
an anchor bolt adapted for anchoring into a wall adjacent to the opening, comprising a head connected to a shaft;
a resilient strap adapted to support a panel, the resilient strap comprising at least one bolt engagement opening for receiving the head of the anchor bolt, a panel support portion, and at least one extension portion joining the at least one bolt engagement opening to the panel support portion, wherein the at least one bolt engagement opening is dimensioned to fit over the head of the anchor bolt, wherein the panel support portion and the at least one extension portion comprise at least one polymer,
wherein the resilient strap comprises a first half-strap joined to a second half-strap;
a bracket for securing the resilient strap to the wall via the head of the anchor bolt, the bracket comprising an aperture for receiving the head of the anchor bolt and a slot extending from the aperture for securing the resilient strap to the wall wherein two strap slots in the plurality of strap slots are adapted to receive the resilient strap and allow the resilient strap to hold the panel over the opening.

2. The system of claim 1, wherein the opening is a window or a door.

3. The system of claim 1, wherein the opening comprises a frame that protrudes beyond the wall adjacent to the opening.

4. The system of claim 1, wherein the anchor bolt is adapted to be permanently anchored into the wall adjacent to the opening.

5. The system of claim 1, wherein the anchor bolt or a portion thereof is adapted to be removed from the wall adjacent to the opening when there is no need to protect the opening.

6. The system of claim 1, wherein the anchor bolt or a portion thereof is adapted to retract into the wall adjacent to the opening when there is no need to protect the opening, and the anchor bolt is adapted to be permanently anchored into the wall adjacent to the opening.

7. The system of claim 6, wherein:
the head connects the shaft via a reciprocating chamber joining the head to the shaft.

8. The system of claim 1, wherein
the at least one bolt engagement opening comprises a first bolt engagement opening, and a second bolt engagement opening; and
the at least one extension portion comprises a first extension portion joining the first bolt engagement opening to the panel support portion, and a second extension portion joining the second bolt engagement opening to the panel support portion.

9. The system of claim 1, wherein the bracket is substantially flat.

10. The system of claim 1, wherein the bracket comprises a slope increasing from the aperture along the slot.

11. The system of claim 1, wherein the slot has a width that is less than the head of the bolt but greater than the width of the shaft.

12. The system of claim 1, wherein the at least one polymer is chosen from polyethylene, polypropylene, nylon, polyester, and combinations thereof.

13. The system of claim 1, wherein the first half-strap is joined to the second half-strap by a seal piece.

14. The system of claim 1, wherein:
the shaft comprises a threaded shaft for anchoring into a wall;
the head further comprises an axial stem; and
the anchor bolt further comprises a reciprocating chamber embracing the axial stem and connecting the head to the threaded shaft.

15. The system of claim 14, wherein the reciprocating chamber comprises a threaded bushing for connecting the threaded shaft.

16. The system of claim 14, wherein the reciprocating chamber comprises a smooth bushing for embracing the axial stem.

17. The system of claim 16, wherein the smooth bushing comprises one or more engagement recesses proximal to the head, and the head comprises, proximal to the smooth bushing, one or more engagement fins adapted to engage the one or more engagement recesses so that when the one or more engagement fins engages the one or more engagement recesses, turning the head turns the smooth bushing and the threaded shaft.

18. The system of claim 15, wherein the reciprocating chamber and the threaded bushing are made from a single piece.

19. The system of claim 15, wherein the reciprocating chamber and the smooth bushing are made from a single piece.

* * * * *